US010689137B2

(12) United States Patent
Wolf et al.

(10) Patent No.: US 10,689,137 B2
(45) Date of Patent: Jun. 23, 2020

(54) CONTINUOUS VERTICAL FORM, FILL AND SEAL MACHINE AND METHOD FOR MAKING RECLOSABLE PACKAGES

(71) Applicant: Triangle Package Machinery Co., Chicago, IL (US)

(72) Inventors: Michael T. Wolf, Chicago, IL (US); Vadim Lubezny, Buffalo Grove, IL (US); Ed Barba, Chicago, IL (US); Joelle Walker, Tinley Park, IL (US); Adam Koolbeck, Chicago, IL (US); Nicholas D. Pankey, Chicago, IL (US)

(73) Assignee: Triangle Package Machinery Company, Chicago, IL (US)

( * ) Notice: Subject to any disclaimer, the term of this patent is extended or adjusted under 35 U.S.C. 154(b) by 64 days.

(21) Appl. No.: 15/905,291

(22) Filed: Feb. 26, 2018

(65) Prior Publication Data

US 2018/0334271 A1 Nov. 22, 2018

Related U.S. Application Data

(60) Provisional application No. 62/509,472, filed on May 22, 2017.

(51) Int. Cl.
*B65B 9/00* (2006.01)
*B65B 9/087* (2012.01)
(Continued)

(52) U.S. Cl.
CPC ..... *B65B 9/087* (2013.01); *B65B 41/16* (2013.01); *B65B 43/04* (2013.01); *B65B 51/146* (2013.01);
(Continued)

(58) Field of Classification Search
CPC .. B65B 9/00; B65B 9/06; B65B 9/067; B65B 9/08; B65B 9/087; B65B 41/16;
(Continued)

(56) References Cited

U.S. PATENT DOCUMENTS 4,437,293 A 3/1984 Sanborn, Jr.
4,549,657 A 10/1985 Martin
(Continued)

FOREIGN PATENT DOCUMENTS

WO WO98/49062 11/1998

OTHER PUBLICATIONS

International Search Report and Written Opinion of International Application No. PCT/US2018/033631 dated Oct. 16, 2018.

*Primary Examiner* — Chelsea E Stinson
(74) *Attorney, Agent, or Firm* — Brinks Gilson & Lione

(57) ABSTRACT

A form, fill and seal machine for making a reclosable package with a reclosable fastener includes a reclosable fastener handling assembly, a forming tube, a vertical seal assembly and a sealing jaw assembly. The handling assembly includes a flattening device, a reclosable fastener feed device and a slack sensor. A form, fill and seal machine alternatively includes a forming tube, a vertical seal assembly disposed adjacent the forming tube, wherein the vertical seal assembly is configured to continuously seal the film tube, and a tear notch applicator positioned downstream of the vertical seal assembly and configured to apply a slit to the continuously moving film tube. The tear notch applicator is positionally fixed in the machine direction. Methods for continuously forming a reclosable package are also provided.

27 Claims, 22 Drawing Sheets

(51) Int. Cl.

| | |
|---|---|
| ***B65B 41/16*** | (2006.01) |
| ***B65B 43/04*** | (2006.01) |
| ***B65B 57/08*** | (2006.01) |
| ***B65B 61/02*** | (2006.01) |
| ***B65B 61/06*** | (2006.01) |
| ***B65B 51/14*** | (2006.01) |
| *B65B 51/10* | (2006.01) |

(52) U.S. Cl.
CPC ..... *B65B 57/08* (2013.01); *B65B 61/02* (2013.01); *B65B 61/06* (2013.01); *B65B 2051/105* (2013.01)

(58) Field of Classification Search
CPC ..... B65B 57/00; B65B 57/04; B65B 57/06; B65B 57/08
USPC ..... 53/203, 213
See application file for complete search history.

(56) References Cited

U.S. PATENT DOCUMENTS

| | | | | |
|---|---|---|---|---|
| 4,709,533 | A | 12/1987 | Ausnit | |
| 4,874,257 | A | 10/1989 | Inagaki | |
| 4,894,975 | A | 1/1990 | Ausnit | |
| 4,909,017 | A | 3/1990 | McMahon et al. | |
| 5,247,781 | A | 9/1993 | Runge | |
| 5,322,579 | A | 6/1994 | Van Erden | |
| 5,412,924 | A | 5/1995 | Ausnit | |
| 5,425,216 | A | 6/1995 | Ausnit | |
| 5,551,208 | A | 9/1996 | Van Erden | |
| 5,564,259 | A | 10/1996 | Stolmeier | |
| 5,715,656 | A | 2/1998 | Pearce | |
| 5,752,370 | A | 5/1998 | Linkiewicz | |
| 5,852,920 | A | 12/1998 | Linkiewicz | |
| 6,012,264 | A | 1/2000 | Linkiewicz | |
| 6,021,621 | A | 2/2000 | Linkiewicz | |
| 6,178,722 | B1 | 1/2001 | McMahon | |
| 6,219,993 | B1 | 4/2001 | Linkiewicz | |
| 6,250,048 | B1 | 6/2001 | Linkiewicz | |
| 6,327,837 | B1 | 12/2001 | Van Erden | |
| 6,477,821 | B1 | 11/2002 | Bois | |
| 6,553,744 | B1 | 4/2003 | Terminella et al. | |
| 6,804,935 | B2 | 10/2004 | Schneider et al. | |
| 7,325,378 | B2 | 2/2008 | Ausnit | |
| 7,530,938 | B2 | 5/2009 | Long | |
| 7,762,300 | B2 | 7/2010 | Wright et al. | |
| 8,002,467 | B2 | 8/2011 | Wright et al. | |
| 8,353,147 | B2 | 1/2013 | Sprehe et al. | |
| 8,506,745 | B2 | 8/2013 | Wright et al. | |
| 8,539,741 | B2 * | 9/2013 | Lubezny | B29C 65/02 53/451 |
| 2003/0050167 | A1 * | 3/2003 | Kinigakis | B65B 9/20 493/394 |
| 2003/0093971 | A1 | 5/2003 | Terminella et al. | |
| 2004/0047524 | A1 * | 3/2004 | Stolmeier | B65B 9/20 383/210 |
| 2006/0214295 | A1 | 9/2006 | Tanaka et al. | |
| 2008/0066430 | A1 | 3/2008 | Lubenzy | |
| 2013/0298505 | A1 * | 11/2013 | Otxoa-Aizpurua Calvo | B65B 1/02 53/452 |
| 2017/0113823 | A1 | 4/2017 | Wolf et al. | |
| 2019/0084710 | A1 * | 3/2019 | Wolf | B65B 51/16 |

* cited by examiner

| 23A | 23B |
|---|---|

CONTINUOUS VERTICAL FORM, FILL AND SEAL MACHINE AND METHOD FOR MAKING RECLOSABLE PACKAGES

This application claims the benefit of U.S. Provisional Application No. 62/509,472, filed May 22, 2017 and entitled "Continuous Vertical Form, Fill and Seal Machine and Method for Making Reclosable Packages," the entire disclosure of which is hereby incorporated herein by reference.

FIELD OF THE INVENTION

The present disclosure relates generally to a vertical form, fill and seal (VFFS) machine, and in particular to a VFFS machine operating continuously while applying a reclosable fastener to a package, together with a method of forming reclosable packages on the continuous VFFS machine.

BACKGROUND

Form, fill and seal bag machines are configured to form packages of different shapes and sizes. Typically, the machine, in sequence, forms a tube from a roll of film and fills the tube with a product, for example a food product. A cross seal mechanism sequentially makes a cross seal, which simultaneously forms a top seal of one bag and a bottom seal of an immediately adjacent bag, such that the latter bag may be filled with the product. The cross seal is then cut to separate the bags.

Typically, form, fill and seal machines may run intermittently, wherein the formed bag is momentarily stopped for sealing and/or cutting, or continuously, wherein the sealing jaws and cutting knife travel with the formed bag to form the seal and separate the bags. In some applications, reclosable fasteners are applied to the bag. The reclosable fasteners may be applied in the machine or transverse directions, typically on intermittent machines.

SUMMARY

The present invention is defined by the following claims, and nothing in this section should be considered to be a limitation on those claims.

In one aspect, one embodiment of a form, fill and seal machine for making a reclosable package includes a reclosable fastener handling assembly. The reclosable fastener handling assembly includes a flattening device, a feed device and a feedback sensor. The flattening device is reciprocally moveable in a machine direction, wherein the flattening device is configured to move with a reclosable fastener material and successively flatten the reclosable fastener material at spaced apart locations. The reclosable fastener feed device is configured to move the reclosable fastener material in the machine direction. The feedback sensor is configured to measure a characteristic of the reclosable fastener material, such as the slack, position, force and/or tension of the reclosable fastener material, downstream of the reclosable fastener feed device and provide an input to the reclosable fastener feed device, wherein the reclosable fastener feed device adjusts the speed of the movement, or length/feed amount, of the reclosable fastener material in response to the input from the feedback sensor. A forming tube is disposed downstream of the feedback sensor, and is configured to receive a film and form a film tube. A vertical seal assembly is disposed adjacent the forming tube and is positionally fixed in the machine direction. The vertical seal assembly is configured to continuously seal the film tube and reclosable fastener material. A sealing jaw assembly is disposed downstream of the vertical seal assembly. The sealing jaw assembly includes a pair of sealing jaws reciprocally moveable in a machine direction. The pair of sealing jaws is configured to move with the film tube and fastener material. The sealing jaws are movable toward and away from each other in a transverse direction and are configured to form a transverse seal on the film tube and fastener material in alignment with the spaced apart locations of flattened reclosable fastener material.

In another aspect, one embodiment of a form, fill and seal machine includes a forming tube configured to receive a film and form a film tube, a vertical seal assembly disposed adjacent the forming tube, wherein the vertical seal assembly is configured to continuously seal the film tube, and a tear notch applicator positioned downstream of the vertical seal assembly. The tear notch applicator is positionally fixed in the machine direction and is configured to intermittently apply a plurality of slits spaced apart in the machine direction to the continuously moving film tube.

In another aspect, one embodiment of a method of forming a package with a reclosable fastener includes moving a reclosable fastener material continuously in a machine direction with a feed device, moving a flattening device with the moving reclosable fastener material in the machine direction, flattening a portion of the reclosable fastener material with the flattening device, measuring a characteristic of the reclosable fastener material, such as the slack, position, force and/or tension of the reclosable fastener material, downstream of the feed device and providing an input to the feed device from the sensor, adjusting a speed of the feed device, or length/feed amount of the reclosable fastener material exiting therefrom, in response to the input from the sensor, forming a film tube on a forming tube downstream of the feedback sensor, continuously sealing the film tube and reclosable fastener material with a vertical seal assembly disposed adjacent the forming tube, wherein the vertical seal assembly is positionally fixed in the machine direction, moving a pair of sealing jaws in the machine direction downstream of the vertical seal assembly, and forming a transverse seal across the film tube and fastener material in alignment with the flattened portions of the reclosable fastener material.

In yet another aspect, one embodiment of a method of forming a tear notch in a film tube includes continuously forming a film tube on a forming tube, continuously sealing the film tube with a vertical seal assembly disposed adjacent the forming tube, wherein the vertical seal assembly is positionally fixed in the machine direction, and intermittently applying a slit to the continuously moving film tube.

In another aspect, a vertical seal assembly includes a first pair of first heater bars extending in a longitudinal direction, with the first heater bars being spaced apart in a lateral direction and defining a first gap therebetween. A second pair of second heater bars extends in the longitudinal direction, with the second heater bars being spaced apart in the lateral direction and defining a second gap therebetween. A first pair of first actuators are coupled respectively to the first pair of first heater bars, wherein the first actuators are each moveable in the lateral direction such that the first gap may be increased or decreased. A second pair of second actuators are coupled respectively to the second pair of second heater bars, wherein the second actuators are each moveable in the lateral direction such that the second gap may be increased or decreased. The first and second pairs of actuators are independently moveable, such that the first and second gaps may independently adjusted.

The various embodiments of the form, fill and seal machines, and methods for the use thereof, provide significant advantages over other form, fill and seal machines, and components used therein. For example and without limitation, the disclosed form, fill and seal machine provides for a continuous bag forming operation incorporating a reclosable fastener. Running a continuous operation provides a substantially higher output of bags, while allowing the film to travel at a lower speed. The lower film speed in turn eliminates dynamic loading of the film, and avoids skipping and other disruptions. The tear notch applicator, positionally fixed in the machine direction, also allows for a continuous bag forming operation, without the need to move the knife, or other film separator, with the film/bag as it progresses through the machine.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The terms "longitudinal" and "machine" as used herein means of or relating to length or the lengthwise direction 30, and refers to the direction of film 4, film tube 12 or reclosable fastener material 40 movement through a form, fill and seal machine. In this way, it should be understood that portions of the reclosable fastener material may be positioned at different angles and/or orientations relative to other portions of the reclosable fastener material upstream or downstream therefrom at any one time during the bag forming process, but with the various portions all travelling in the longitudinal or machine direction. Likewise, the film 4 and reclosable fastener material 40 may travel along separate "machine" direction paths before being joined at the vertical seal assembly. The terms "downstream" and "upstream" refer to the relative position of the film and/or reclosable fastener material as they travel from a supply roll to the final bag formation, with a component lying "upstream" from a reference point being closer to the supply roll in the process and a component lying "downstream" from the reference point being closer to the final bag formation. The terms "lateral" and "transverse" as used herein, means situated on, directed toward or running from side to side, and refers to a direction transverse to the machine direction movement of the film and reclosable fastener material through a form, fill and seal machine.

The term "coupled" means connected to or engaged with whether directly or indirectly, for example with an intervening member, and does not require the engagement to be fixed or permanent, although it may be fixed or permanent (or integral), and includes both mechanical and electrical connection. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. For example, a "first" set of heating bars may be later referred to as a "second" set of heating bars depending on the order in which they are referred. It should also be understood that designation of "first" and "second" does not necessarily mean that the two components or values so designated are different, meaning for example a first set may be the same as a second set, with each simply being applicable to separate but identical components.

U.S. Pat. Nos. 5,715,656, 5,752,370 and 8,539,741, and U.S. Pub. No. 2017/0113,823, assigned to Triangle Package Machinery Company, the same Assignee as the present application, disclose various components of form, fill and seal machines, the entirety of which patents and publication are hereby incorporated herein by reference.

Figure 5:
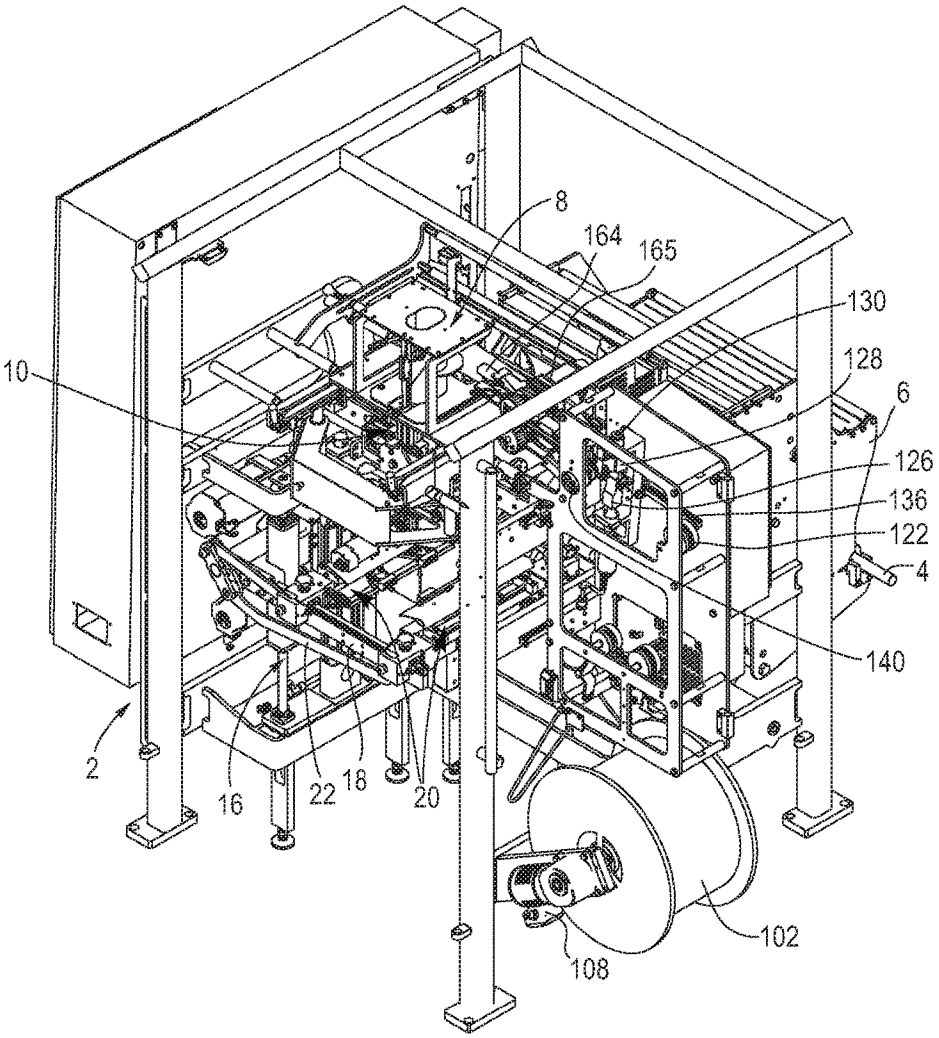
FIG. 5 is a perspective view of one embodiment of a form, fill and seal machine.
Figure 20:
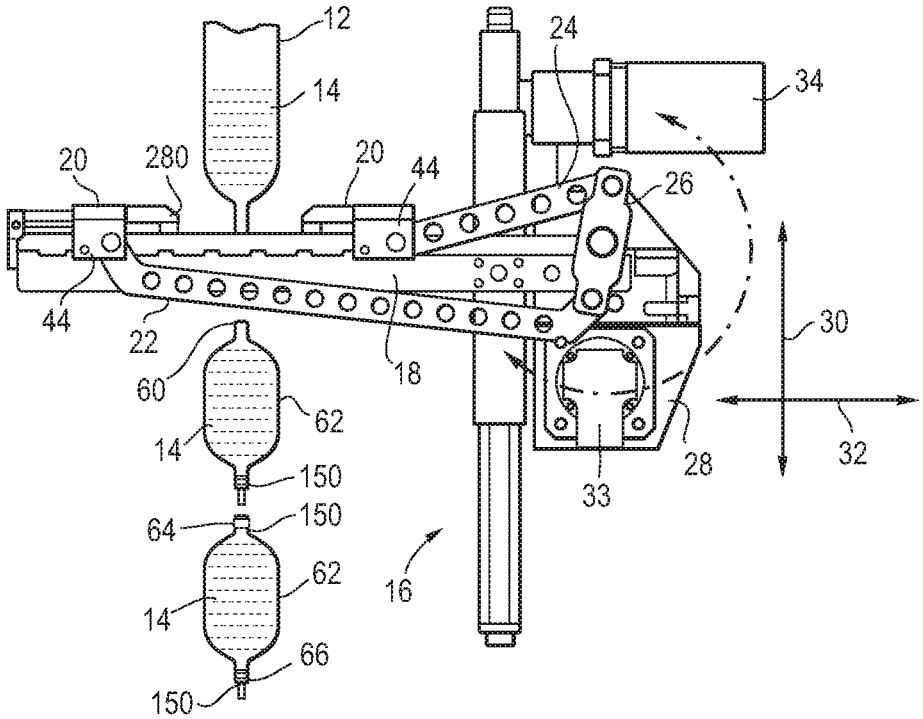
FIG. 20 is a side view of a sealing and cutting assembly.

Form, Fill and Seal Machine:

Referring to FIGS. 5 and 20, a form, fill and seal machine includes a frame 2 and a film cage 6 configured to hold and store rolls 4 of film. The film cage may include dancer rollers that control/maintain the tension of the film as it is introduced to the machine. The dancer rollers speed up or slow down the power unwind of the film from the film roll 4. The film is unrolled from the roll 4 and is guided to a forming shoulder 8, which forms the film into a tubular structure around a forming tube. As is well known in the art, packages of various shapes and sizes can be formed by changing the forming tube and forming shoulder. A vertical seal assembly 10 seals the film to form a film tube 12. Product 14, including for example and without limitation various liquid or solid food products, is loaded through an open end of the forming tube into the film tube 12, which is sealed to form a bag 62 filled with the product 14.

Reclosable Fastener Material Handling Assembly

Referring to FIGS. 1, 13-17, 22 and 23, a reclosable fastener handling assembly 100 is shown. The various components of the reclosable fastener handling assembly are coupled to and supported by the frame 2. The reclosable fastener handling assembly 100 feeds the reclosable fastener material 40 at a constant speed and consistent tension with intermittent spaced apart flattened portions, defined as welds or crushed portions, repeating such that the flattened portions 150 match the location of a bag cutoff as described below. The phrase "reclosable fastener material" refers to a strip of such material, which may be stored on a roll 102, and includes without limitation reclosable fastener material strips having interlocking male and female fastener elements, hook and loop fasteners, interlocking mushroom heads, and like systems, preferably made of a plastic material, such as polyethylene or other plastics. It should be understood the reclosable fastener material 40 may be configured with a plurality of sliders, which may be grasped and manipulated to effect the locking and unlocking of the reclosable fastener material strips. In one embodiment, the reclosable fastener material includes interlocking elements 104 and a pair of mounting flanges 106 extending transverse to the interlocking elements.

Figure 1:
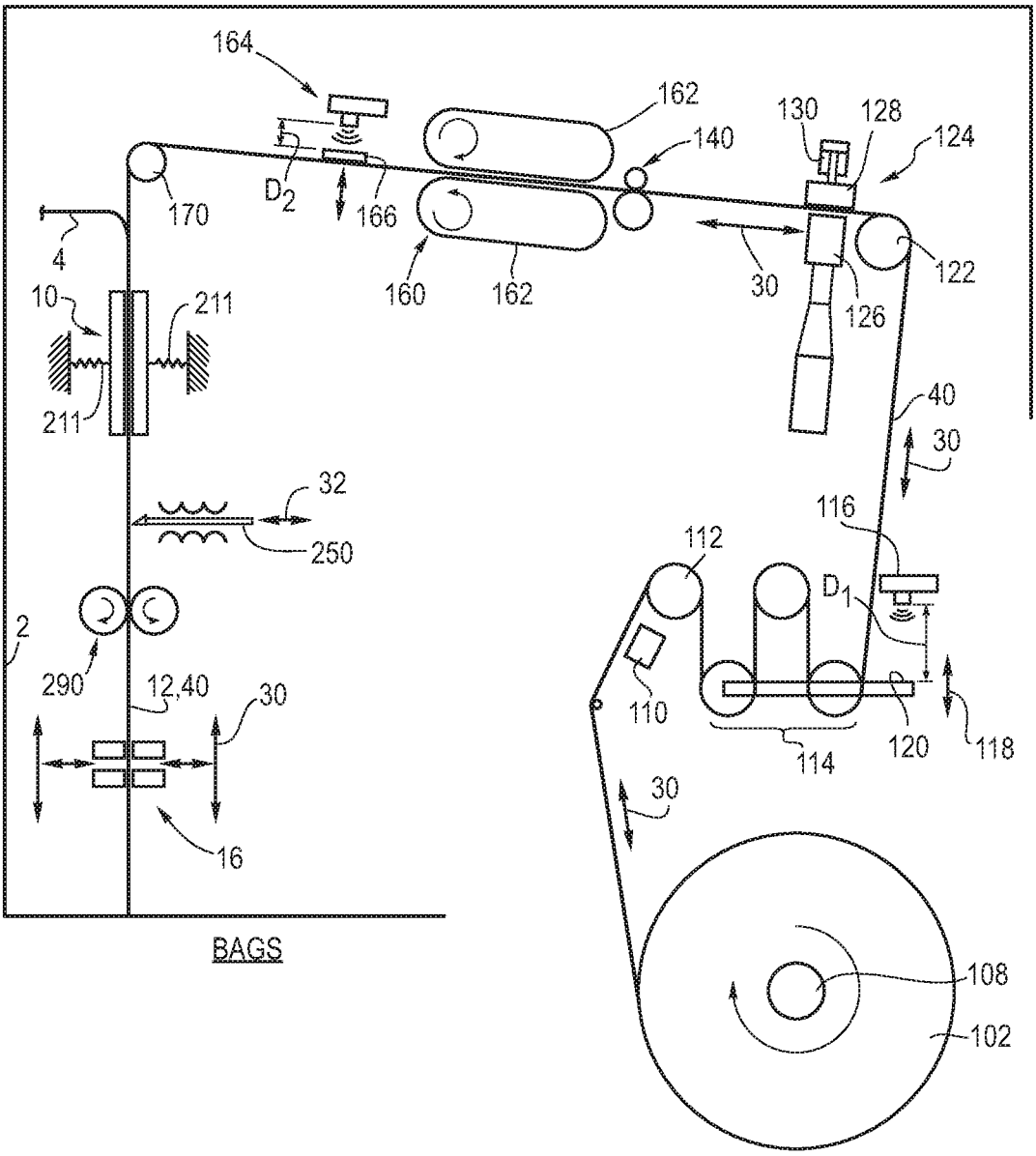
FIG. 1 is a schematic diagram of one embodiment of a vertical form, fill and seal machine showing the progression of reclosable fastener material through the machine.

The roll 102 of reclosable fastener material is mounted on a shaft connected to a variable frequency drive VFD unwind motor 108. The reclosable fastener material moves past a detection sensor 110, which confirms that the reclosable fastener material is present, and passes over a fixed pulley roller 112. The reclosable fastener material then passes through an assembly of dancing rollers 114, which can move up and down on a slide 118. The dancing rollers 114 apply a constant tension to the reclosable fastener material 40 as determined and set by the weight of the assembly. An unwind roller sensor 116 is configured as a distance or proximity sensor that detects the position of the moveable dancing rollers 114, or target portion 120 coupled thereto, as shown in FIG. 1. The distance measurement (D1) is used as feedback for the VFD (FIGS. 22 and 25), such that the unwind motor 108 varies its speed to achieve a consistent dancing rollers 114 position, and thereby a consistent feed rate and tension. A controller, such as a programmable logic controller (PLC), receives input from the sensors 110, 116 and controls the speed of the VFD motor 108, or servo drive portion thereof. It should be understood that all of the components disclosed herein are coupled to and supported by the frame 2, directly, or through another component.

Figure 15:
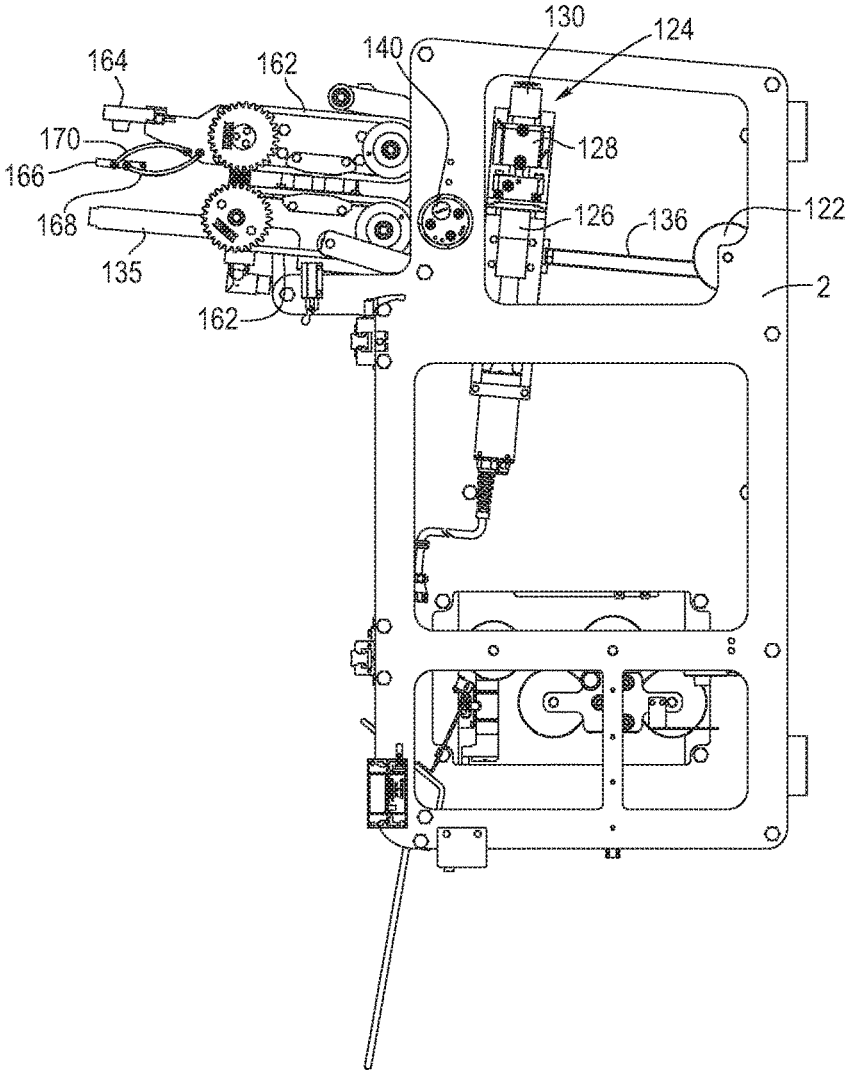
FIG. 15 is a front view of the reclosable fastener handling assembly shown in FIG. 13.
Figure 16:
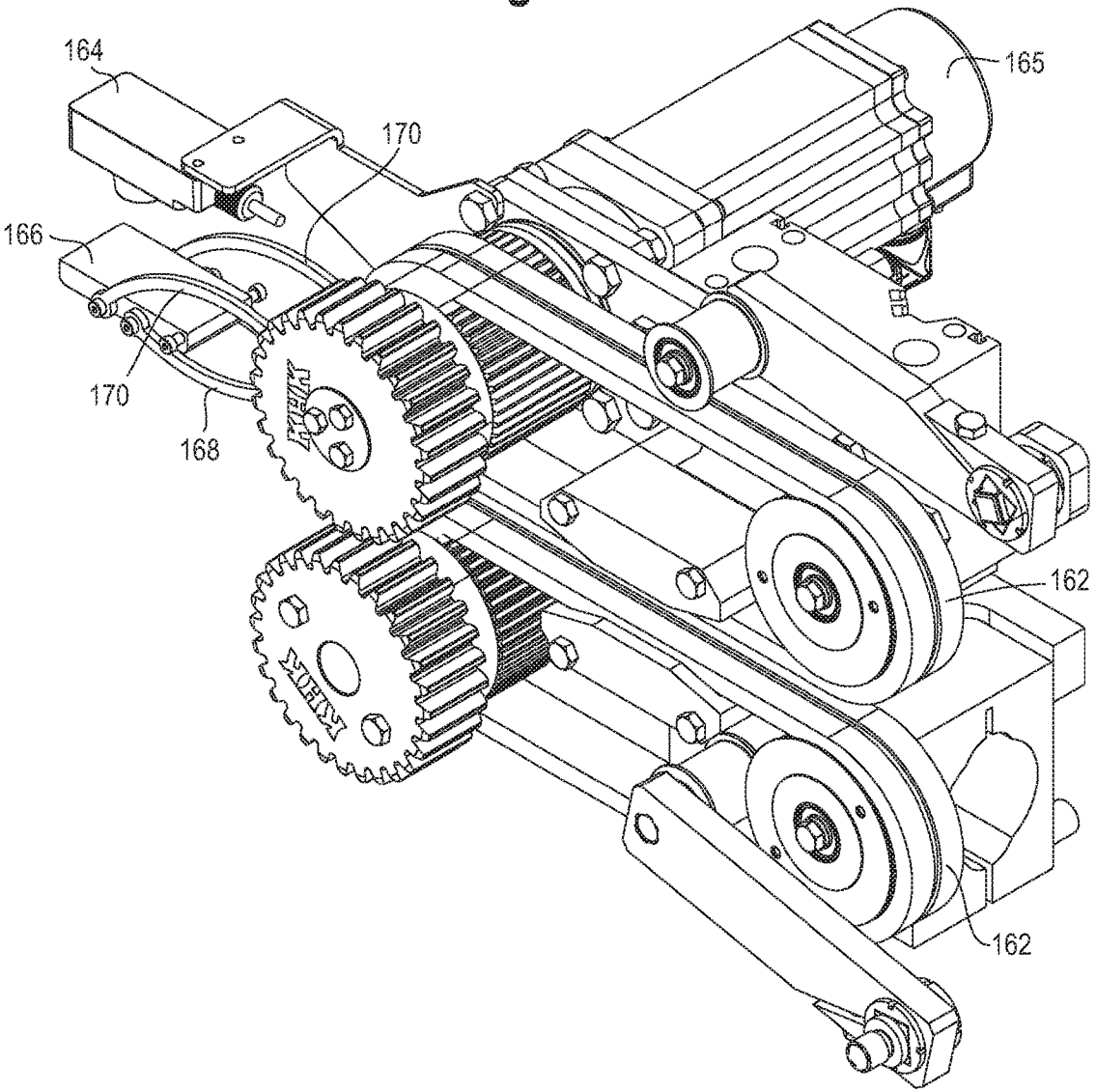
FIG. 16 is a perspective view of the reclosable fastener feed device and slack sensor.
Figure 17:
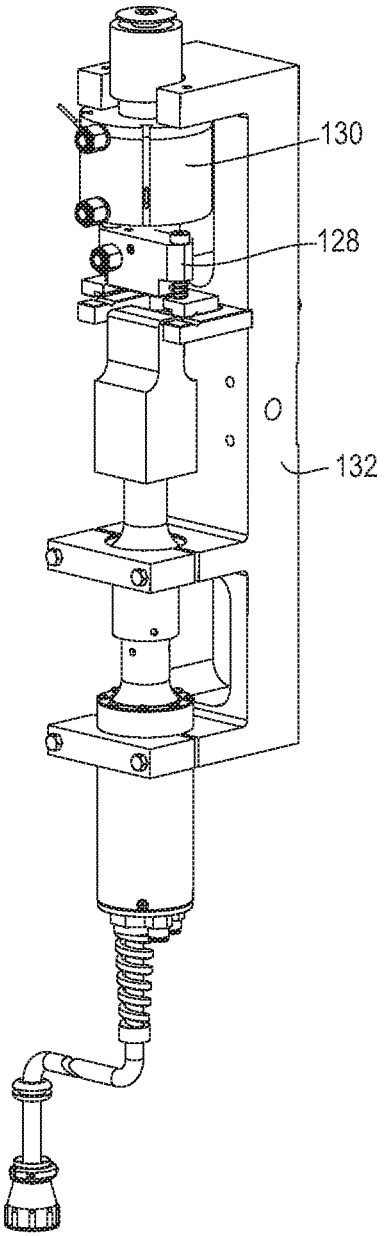
FIG. 17 is a perspective view of one embodiment of a reclosable fastener flattening device.
Figure 18:
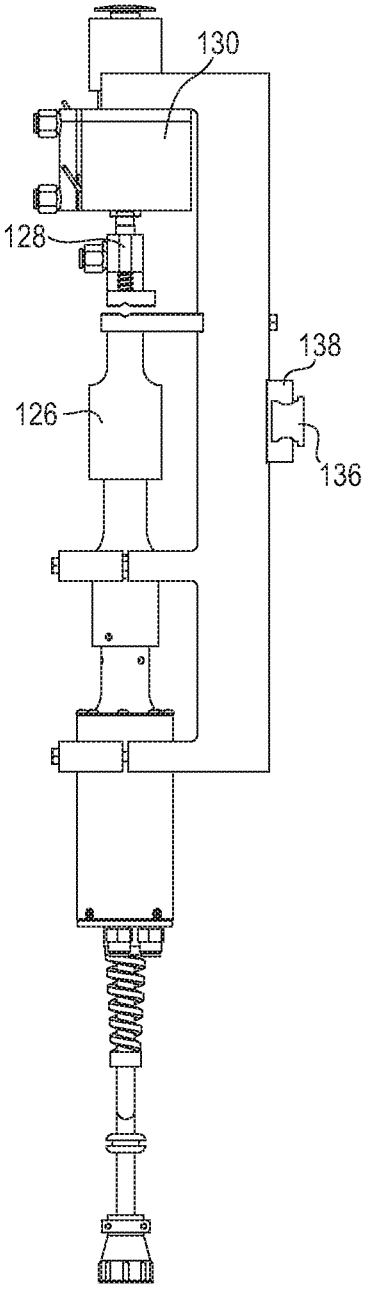
FIG. 18 is a side view of the flattening device shown in FIG. 17.
Figure 19:
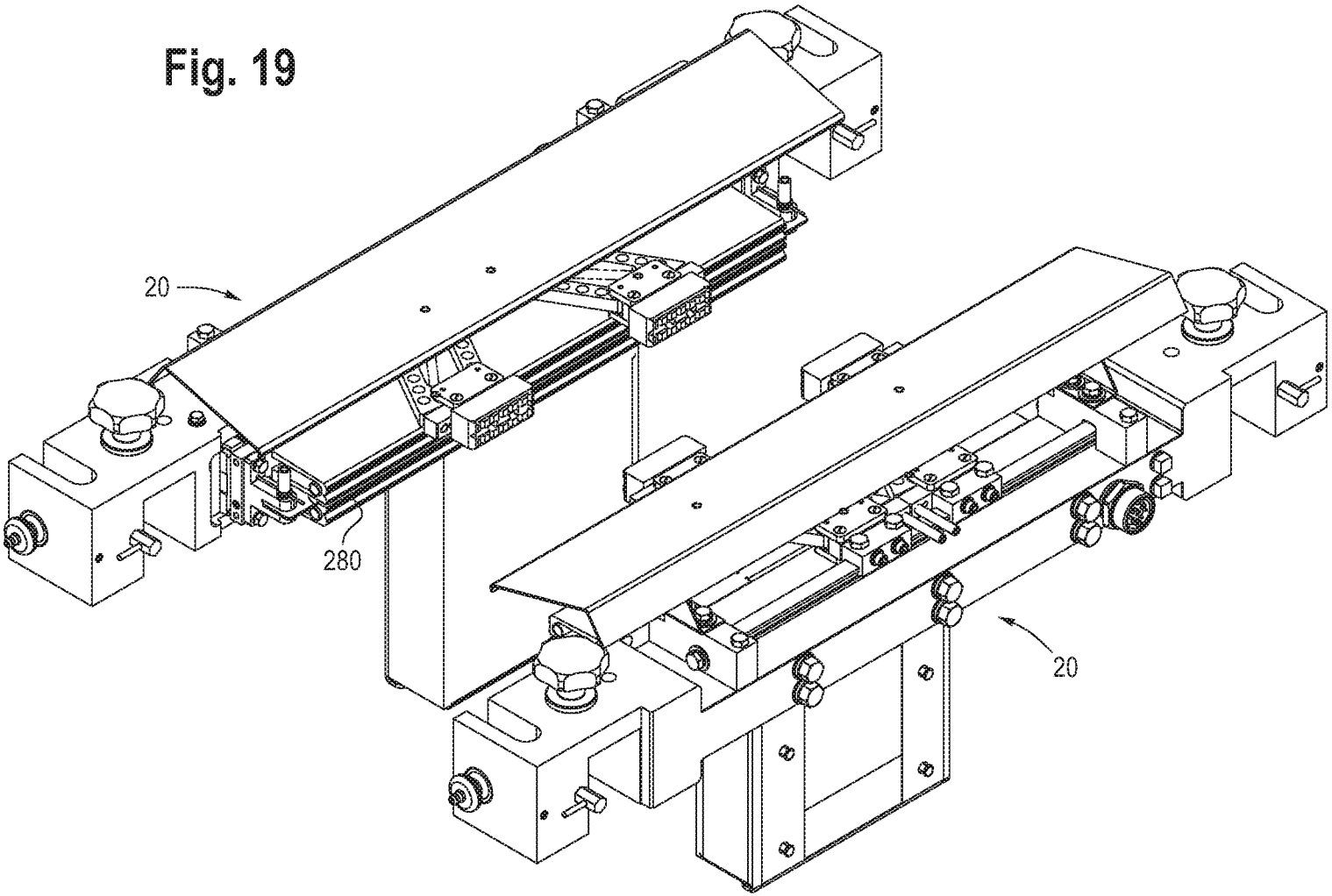
FIG. 19 is a perspective view of a pair of sealing jaws.

Referring to FIGS. 1, 13-15, 22, 23, 25 and 26, the reclosable fastener material 40 travels downstream in the machine direction 30 from the dancing rollers 114 to a fixed pulley roller 122, affixed to the frame, adjacent a flattening device 124, configured in one embodiment as an ultrasonic weld system. The ultrasonic weld system includes an ultrasonic stack 126, or horn, positioned on one side of the reclosable fastener material and an anvil 128 mounted to an air cylinder 130 and positioned on an opposite side of the reclosable fastener material. The flattening device is mounted on a bracket 132, which in turn is coupled to a slide 138 that moves along a rail 136 or track supported by the frame 2. A linear servo motor 134 reciprocally moves the flattening device back and forth on the rail 136 along a machine direction 30, or parallel to the path of the reclosable fastener material. A slider 135, or magnet encapsulated in a metal rod, passes through and is reciprocally driven by the motor 134, with the flattening device being moved therewith. The stator of the motor 134 is clamped in the cavity shown on FIG. 16. As shown in FIG. 15, the ultrasonic stack 126 is as close to the zip feed as possible. The stack may be pushed back towards the pulley, providing it with a range of travel, for example 8 inches, in which case the slider would be upstream of the zip feed encoder. The slider passes all the way through the stator during operation.

Figure 21:
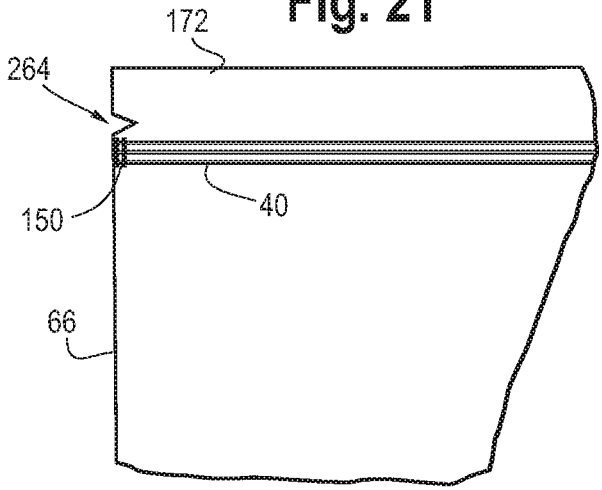
FIG. 21 is a partial front view of a reclosable bag having a tear notch.
Figure 26:
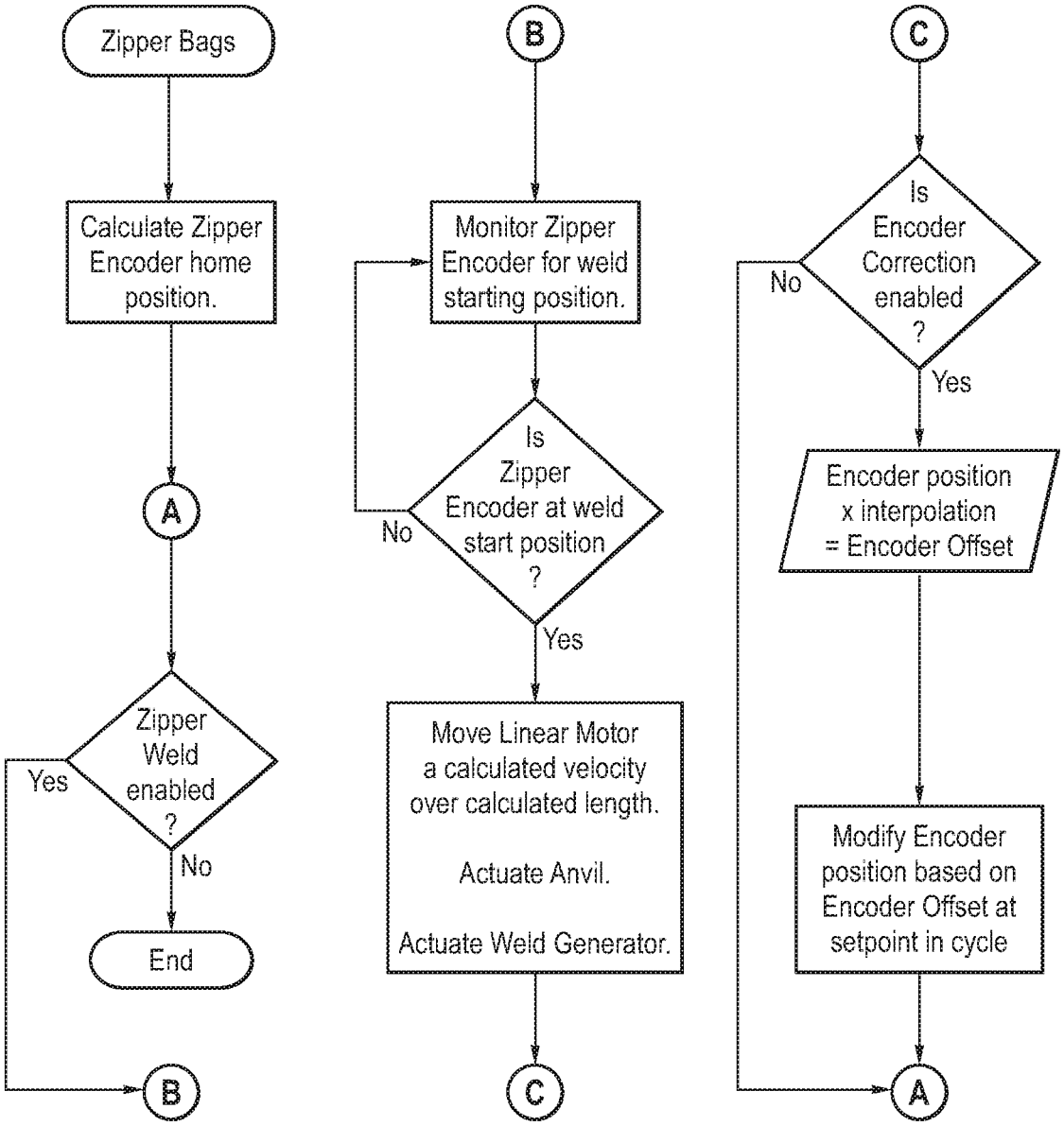
FIG. 26 is a flow chart illustrating the software/algorithm control for the reclosable fastener weld.

An encoder 140 positioned downstream of the flattening device 124 monitors the speed and position of the reclosable fastener material 40. Using feedback from the encoder 140, a controller, e.g. a programmable logic controller (PLC), matches the speed of the flattening device 124 with the speed of the reclosable fastener material, with the flattening device 124 clamping to the moving reclosable fastener material by actuating the cylinder 130, flattening (e.g., welds or crushes) the reclosable fastener material, un-clamping from the moving reclosable fastener material, and returning in an upstream direction for the next cycle. This motion profile is similar to the motion profile used by the jaw assembly to seal and cut each bag as the film moves continuously down the forming tube as disclosed below. After the reclosable fastener material is flattened or crushed at spaced apart locations, the control system identifies and controls the locations of the flattened portions 150 so that the flattened portions eventually align with the bag cutoff downstream in the machine and process as shown in FIGS. 21 and 26. Referring to FIG. 26, the encoder is monitored to identify the welding/flattening starting position, with the control system capable of adjusting the encoder position based on a calculated encoder offset.

After passing by or through the encoder 140, the reclosable fastener material travels by or through a reclosable fastener feed device 160, which is configured to move the reclosable fastener material in the machine direction 30. In one embodiment, the reclosable fastener feed device includes a pair of spaced apart pinch belts 162 (continuous loops) driven by a servo motor 165, with the belts 162 engaging opposite sides of the reclosable fastener material 40, maintaining positive control of the reclosable fastener material, and propelling the reclosable fastener material 40 forward in the machine direction 30. In other embodiments, the reclosable fastener material feed device may include spaced apart rollers, spaced apart vacuum belts, or combinations thereof.

Downstream of the feed device, a feedback sensor 164 measures a characteristic of the reclosable fastener material, including for example and without limitation the slack, position, force and/or tension of the reclosable fastener material. In one embodiment, the feedback sensor 164 is configured as a slack sensor that measures the slack of the reclosable fastener material. In other embodiments, the feedback sensor may be configured as, or may include, the encoder 140, or may be configured as a tension sensor or other sensor, or combinations of the aforementioned sensors. In one embodiment, the reclosable fastener material 40 travels below and is engaged by a dancer plate 166 coupled to and supported by two pairs of links 168, 170. The dancer plate 166 moves up or down in response to the tension (or slack) of the reclosable fastener material 40, with the sensor 164 measuring the distance (D2) between the sensor 164 and the dancer plate 166, which defines a target portion for the sensor 164. The position of the target portion, or plate 166, provides an input to the feedback (slack) sensor 164, which in turn provides an output communicated to the reclosable fastener feed device 160, or controller (PLC) associated therewith, as a sensor input. In response, the controller and the servo motor driving the reclosable fastener feed device 160 makes small corrections to maintain a consistent slack in the reclosable fastener material. For example, the reclosable fastener feed device adjusts the speed of the movement, or length/feed amount, of the reclosable fastener material in response to the input from the feedback sensor. This has the effect of maintaining the reclosable fastener material 40 at a consistent tension as it passes through the remaining downstream systems.

Vertical Seal Assembly

Figure 2:
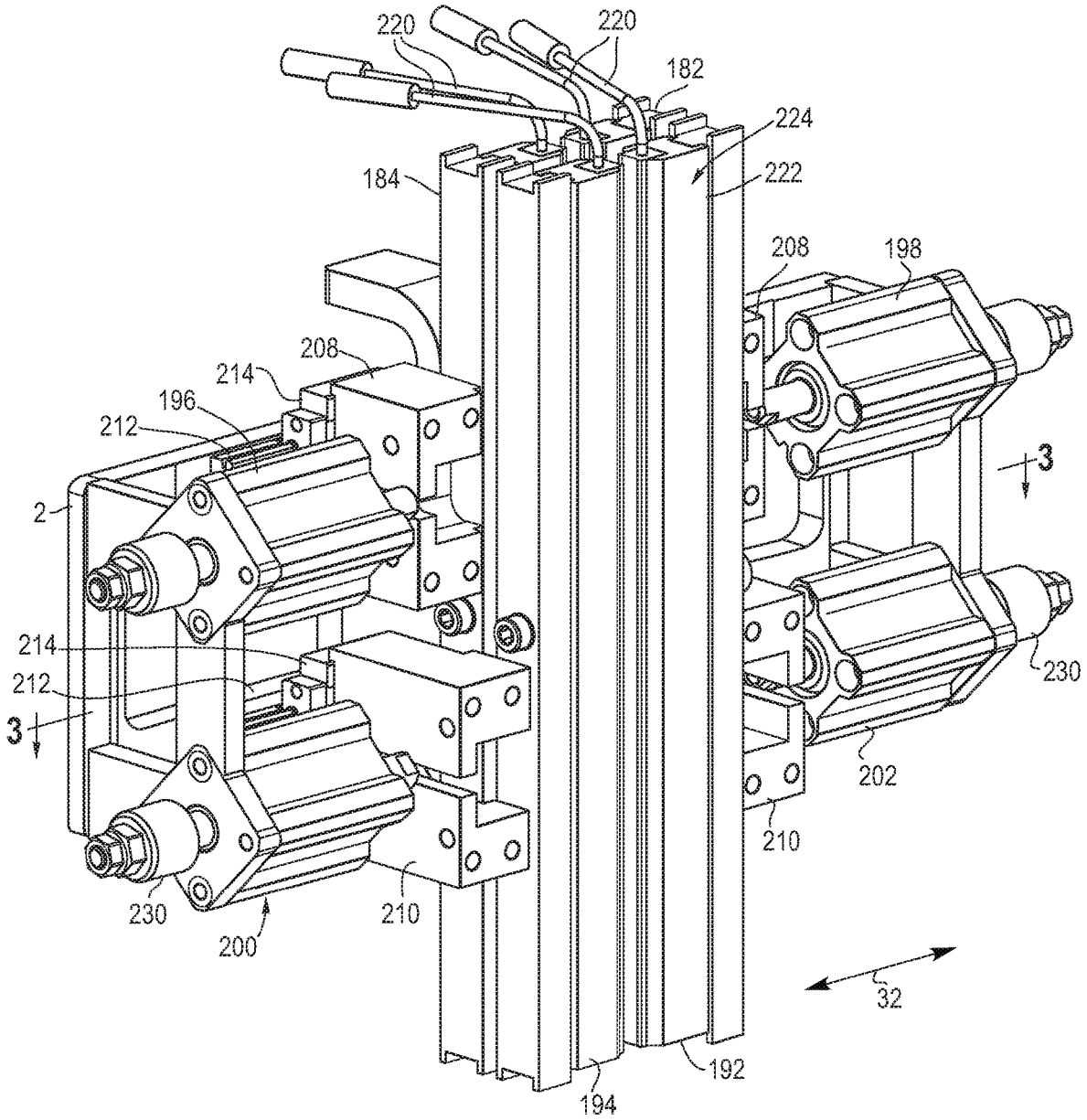
FIG. 2 is a perspective view of one embodiment of a vertical seal assembly.
Figure 3:
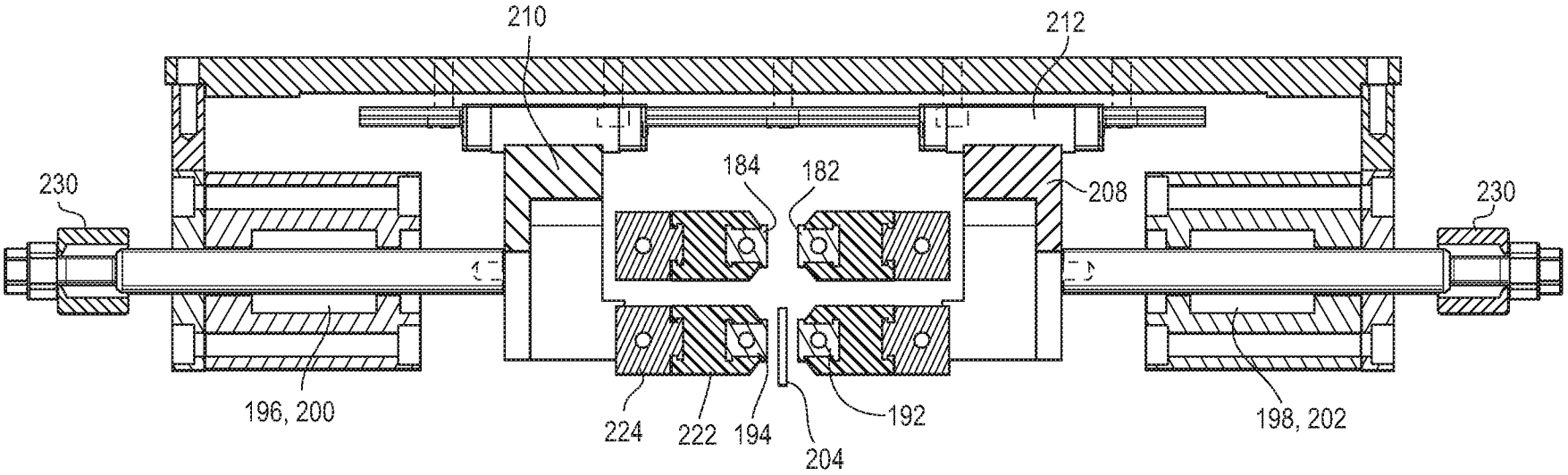
FIG. 3 is a cross-sectional view of the vertical seal assembly taken along line 3-3 in FIG. 2.
Figure 4:
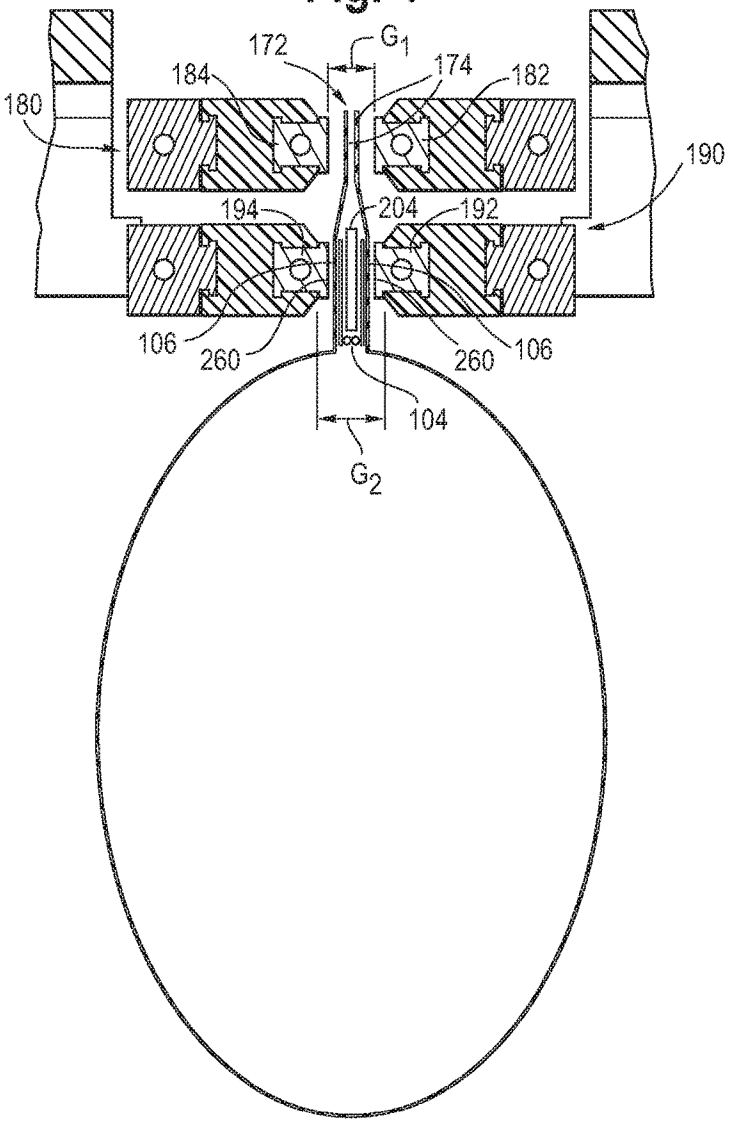
FIG. 4 is a partial cross-sectional view showing the passage of a film tube and reclosable fastener material through the vertical seal assembly.
Figure 6:
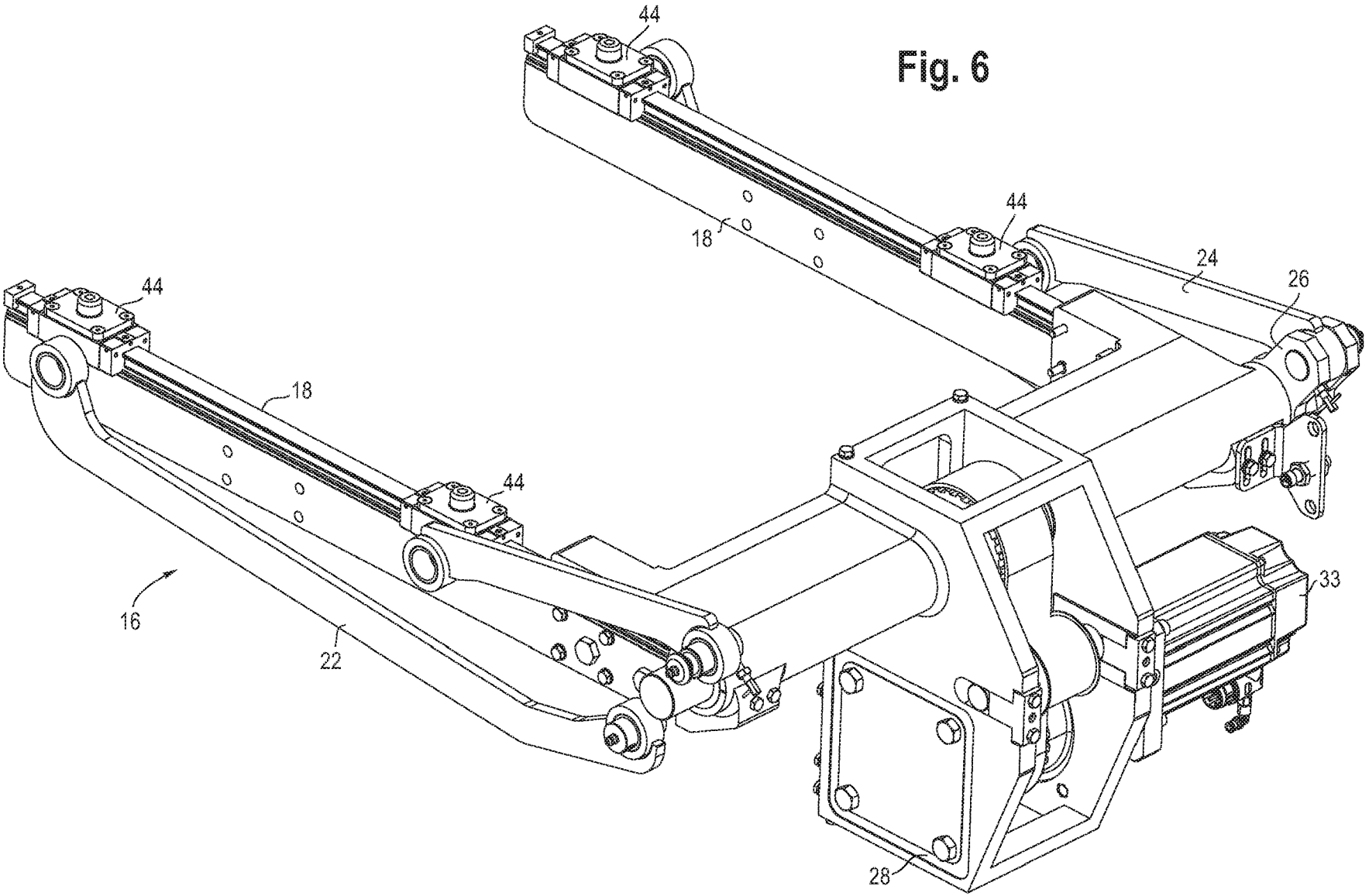
FIG. 6 is a perspective view of the horizontal drive component of the sealing jaw assembly.
Figure 7:
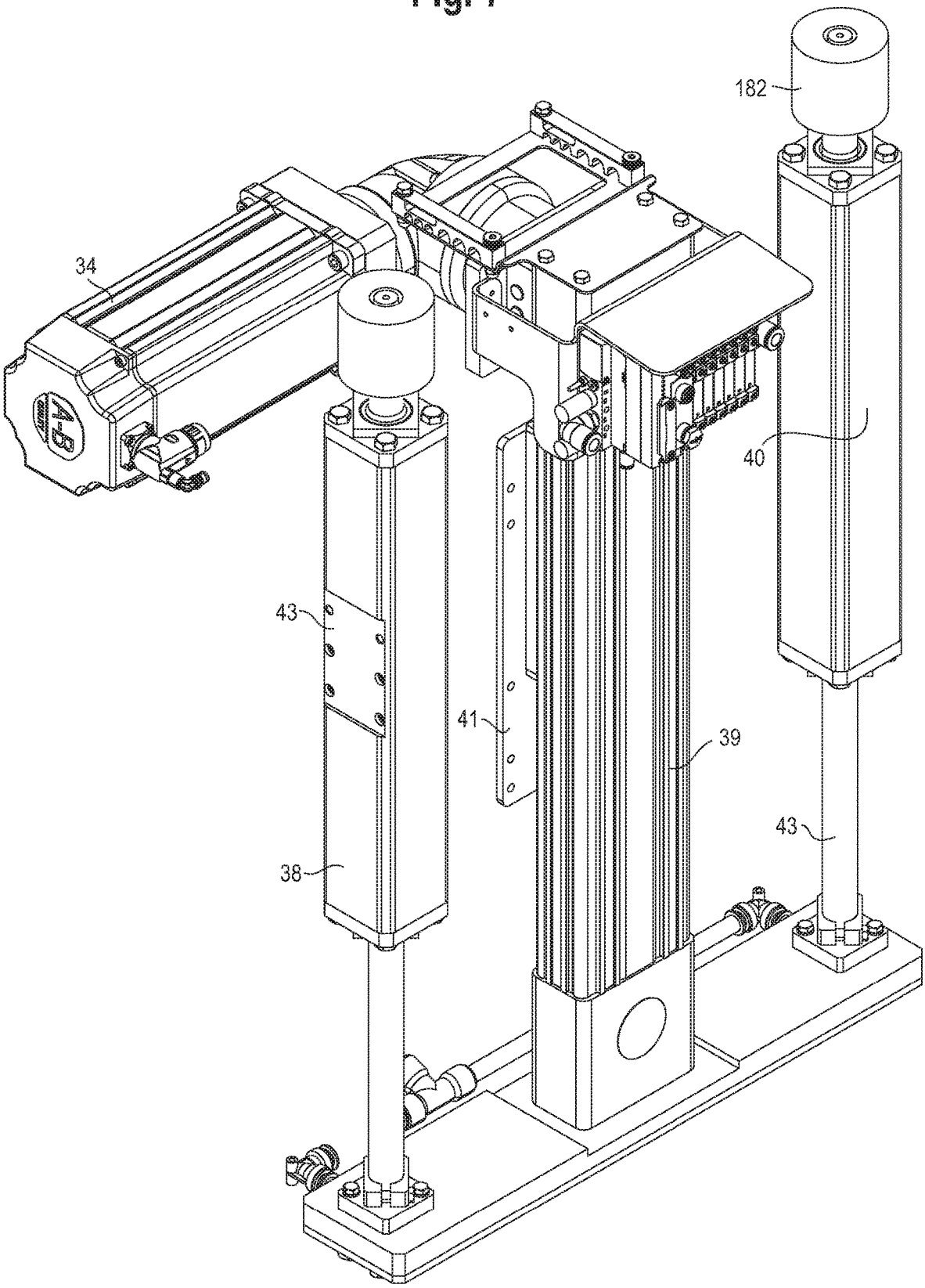
FIG. 7 is a perspective view of the vertical drive component of the sealing jaw assembly.
Figure 8:
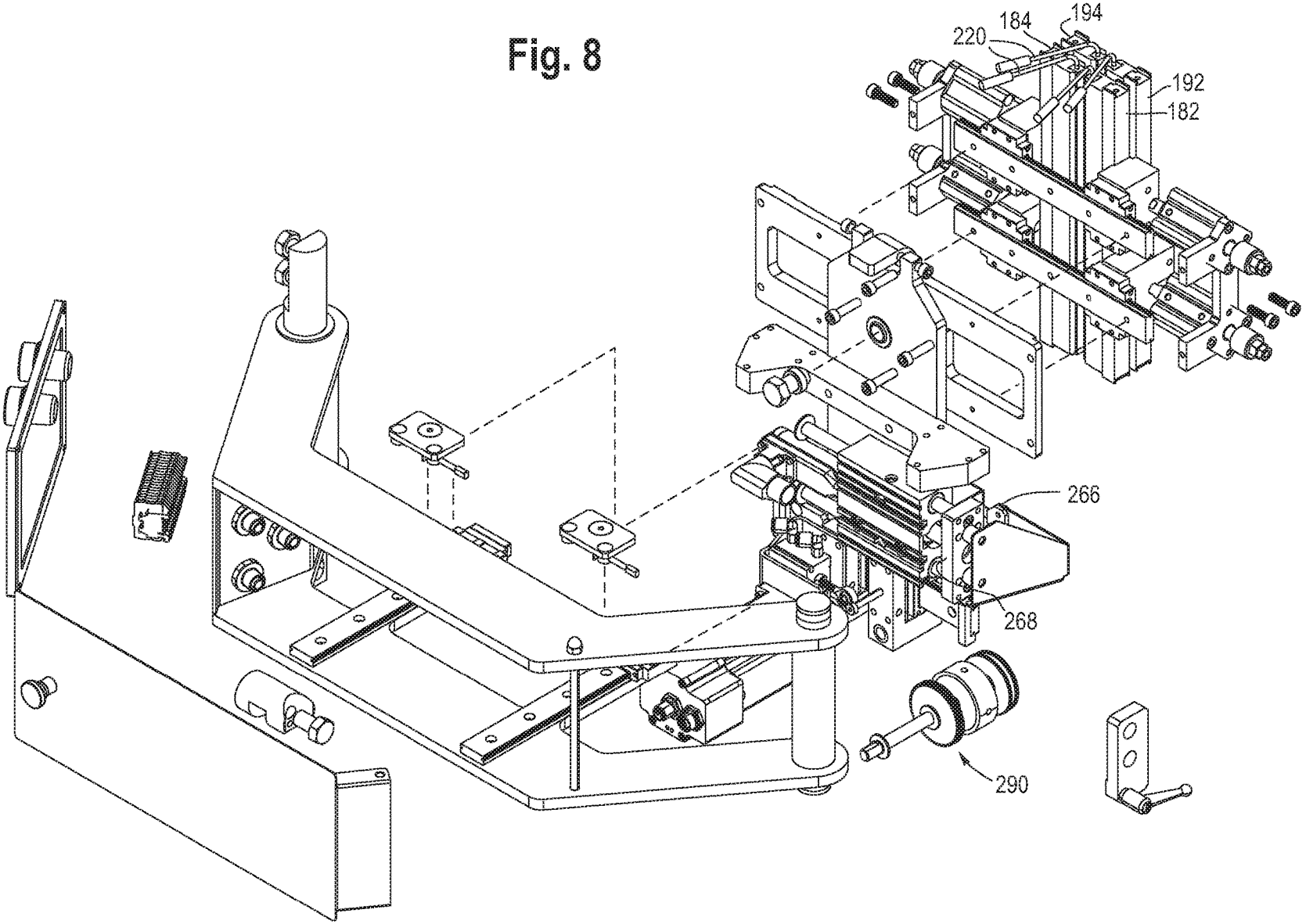
FIG. 8 is an exploded rear perspective view of the vertical seal assembly and tear notch applicator.
Figure 9:
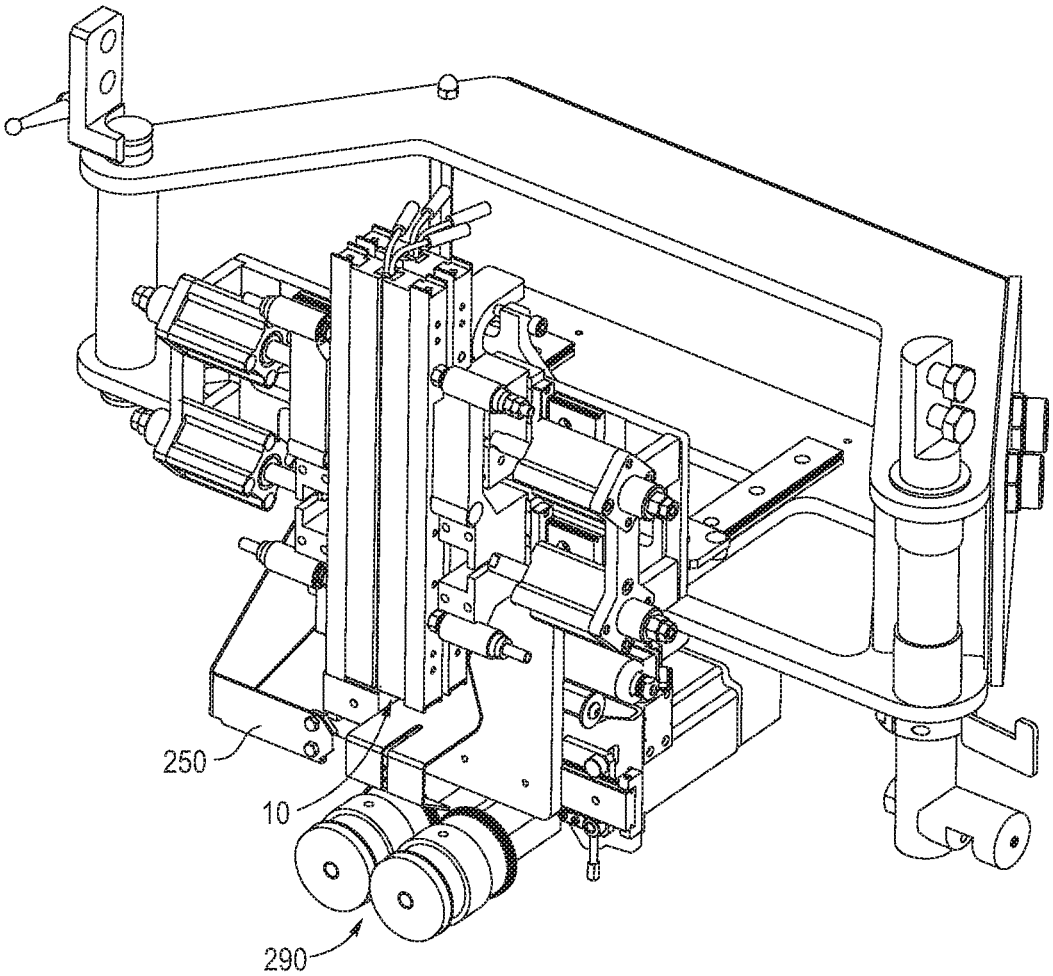
FIG. 9 is a front perspective view of the vertical seal assembly and tear notch applicator shown in FIG. 8.
Figure 10A:
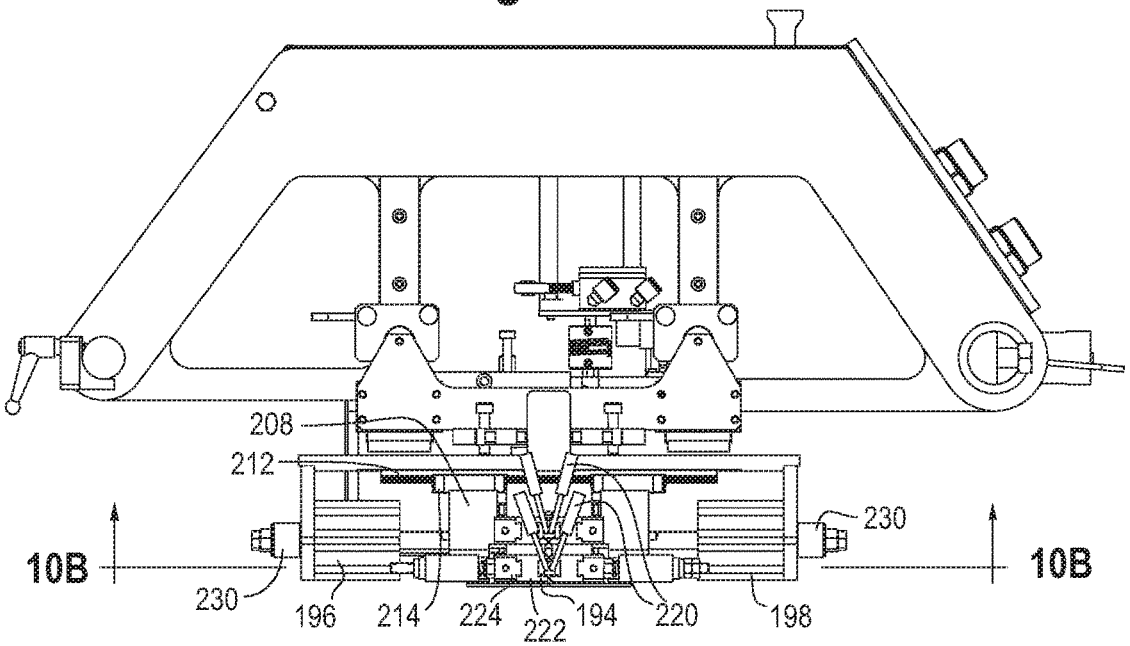
FIG. 10A is a top view of the vertical seal assembly and tear notch applicator shown in FIG. 9.
Figure 10B:
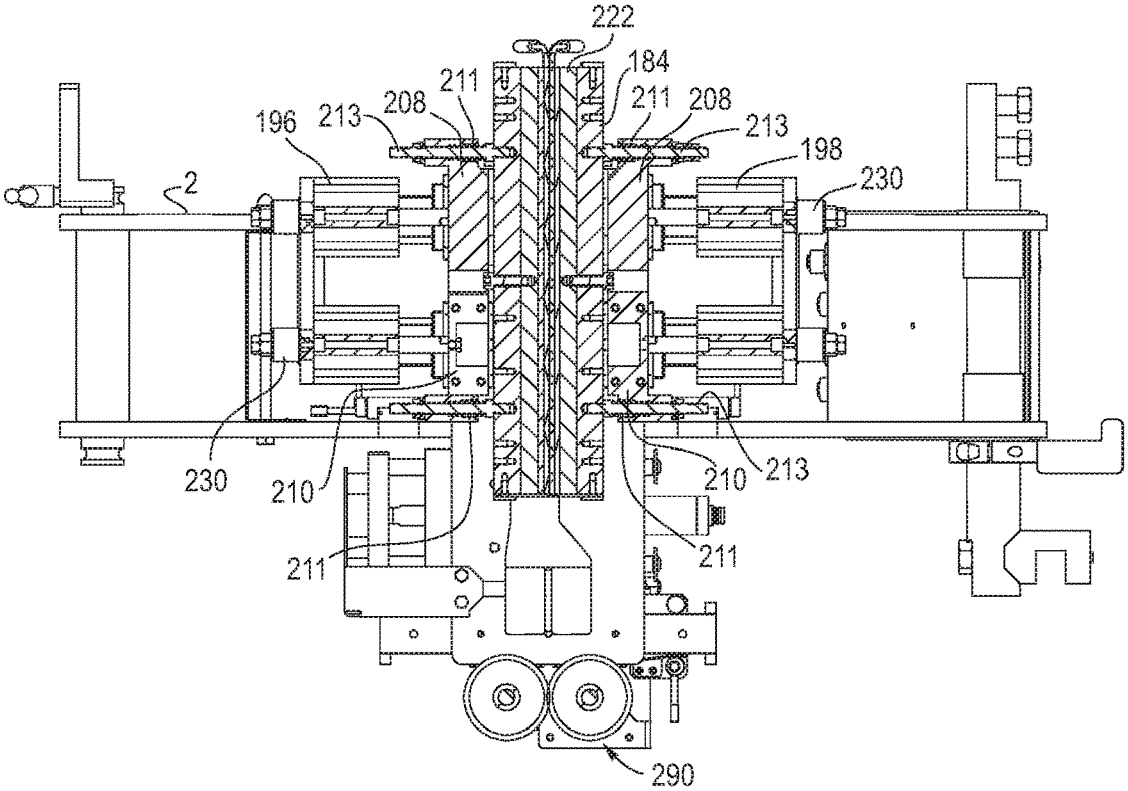
FIG. 10B is a cross-sectional view of the vertical seal assembly and tear notch applicator taken along line 10B-10B shown in FIG. 10A.
Figure 11:
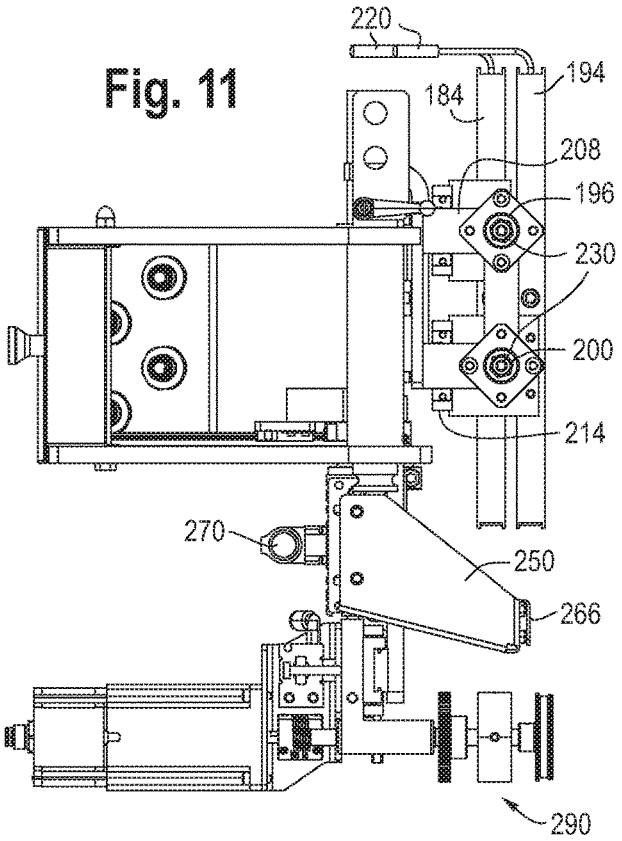
FIG. 11 is a side view of the vertical seal assembly and tear notch applicator shown in FIG. 8.
Figure 12:
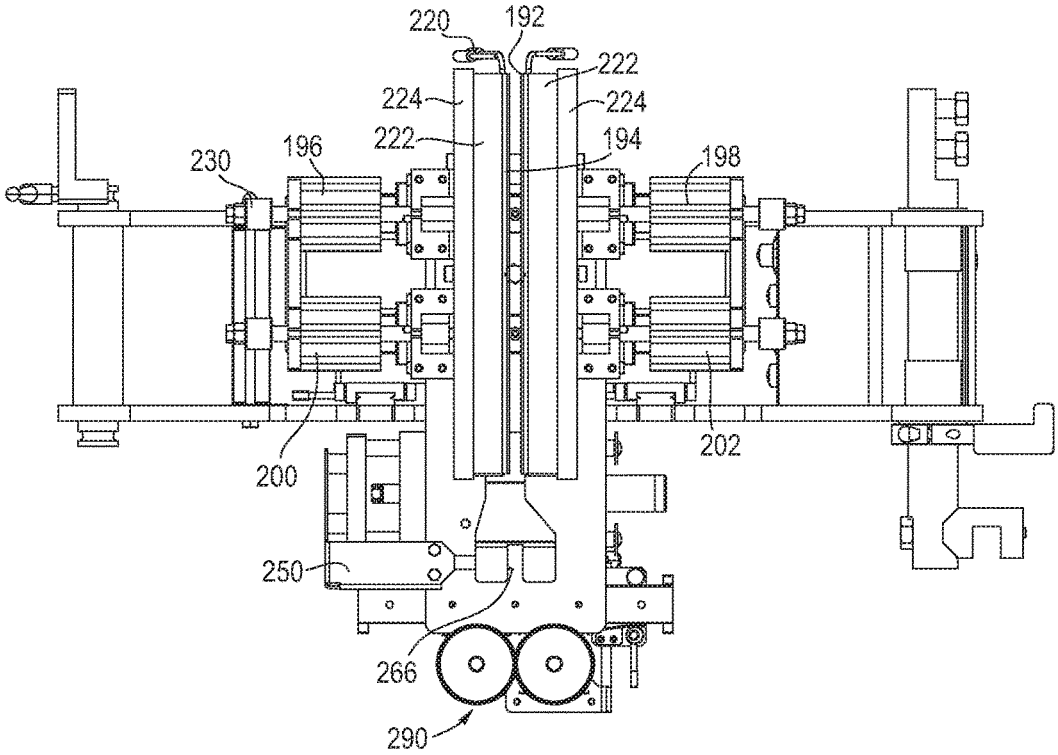
FIG. 12 is a front view of the vertical seal assembly and tear notch applicator shown in FIG. 8.
Figure 13:
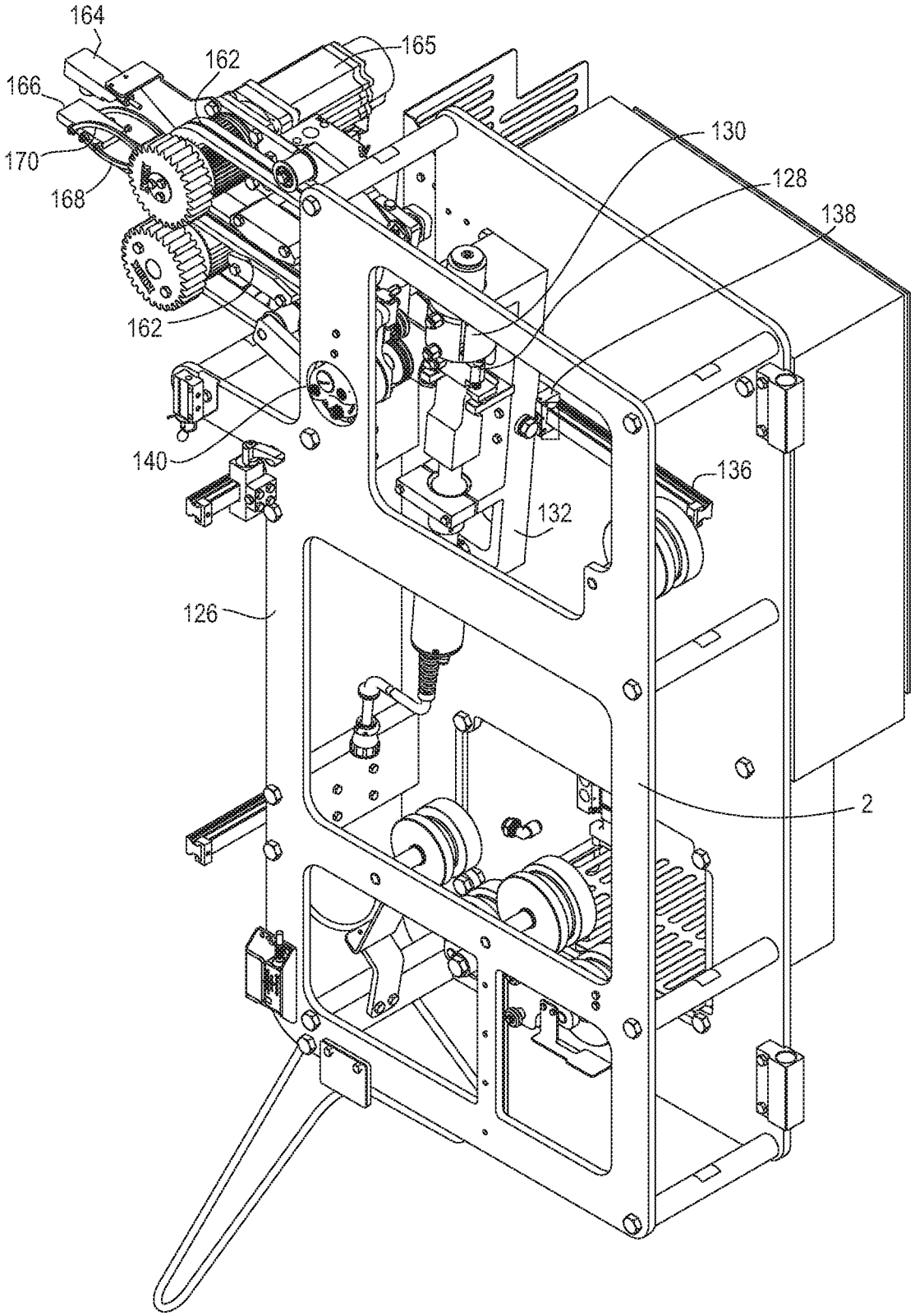
FIG. 13 is a perspective view of the reclosable fastener handling assembly.
Figure 14:
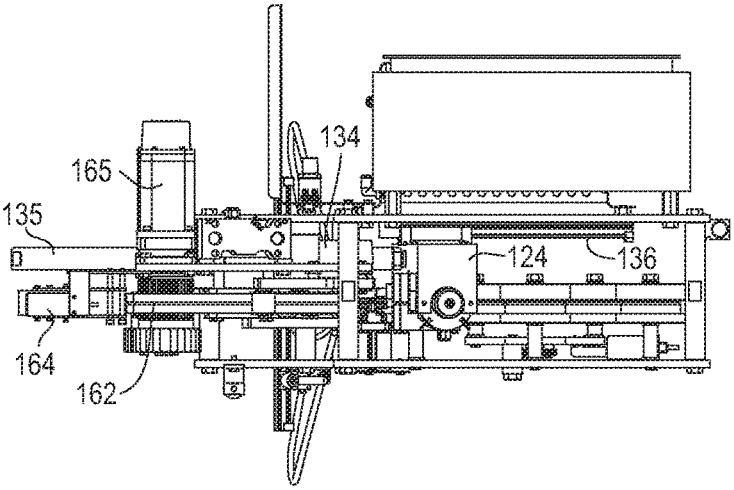
FIG. 14 is a top view of the reclosable fastener handling assembly shown in FIG. 13.

Referring to FIGS. 1-4 and 8-12, the reclosable fastener material 40 travels in the machine direction 30 over a forming set pulley 170, whereinafter the reclosable fastener material is introduced to and joined with the film tube 12 at a vertical seal assembly 10. At the vertical seal location, the reclosable fastener material 40 and film 4 are traveling at the same speed. The vertical seal assembly 10 attaches the reclosable fastener material 40 to the film tube 12 between overlapping edges 174 thereof while also forming a separate vertical edge seal 172 between the overlapping edges 174 of the film tube 12. The sealing of the reclosable fastener material to the film tube 12 and of the film tube edge seal 172 are done continuously, with the film 4 passing between two sets of heaters 180, 190, both of which are positionally fixed in the machine direction. The phrase "positionally fixed" means the component is not moveable in the indicated direction (e.g., machine, vertical, lateral, transverse, etc.) during the normal operation of the machine, but may or may not be adjusted in such a direction when the machine is not operating. The sets of heaters include a first set of spaced apart heater bars 182, 184 configured to seal the outer portions of the overlapping edges 174 of the film tube and form the edge seal 172, and a second set of spaced apart heater bars 192, 194 configured to seal the reclosable fastener material 40, and in particular the mounting flanges 106, to the edges 174 and film tube 12 as shown in FIGS. 3 and 4. The first set of heater bars includes a first pair of first heater bars extending in a longitudinal direction, with the first heater bars 182, 184 being spaced apart in a lateral direction and defining a first gap (G1) therebetween. The second set of heater bars includes a second pair of second heater bars 192, 194 extending in the longitudinal (machine) direction, with the second heater bars being spaced apart in the lateral (transverse) direction and defining a second gap (G2) therebetween. The gaps G1 and G2 may be the same or different, and are both independently adjustable.

A first pair of first actuators 196, 198 are coupled respectively to the first pair of first heater bars 182, 184, wherein the first actuators are each moveable in the lateral direction such that the first gap (G1) may be increased or decreased. A second pair of second actuators 200, 202 are coupled respectively to the second pair of second heater bars 192, 194, wherein the second actuators are each moveable in the lateral direction 32 such that the second gap (G2) may be increased or decreased. The first and second pairs of actuators are independently moveable, such that the first and second gaps may independently adjusted. The heater bars are coupled to brackets 208, 210 that are supported by ball bearing slides 214 that move along rails 212 coupled to the frame 2.

A guide blade 204 is positioned between the second set of heater bars 192, 194 and is inserted between the two mounting flanges 106 of the reclosable fastener material so as to prevent those flanges from being sealed to each other. Rather, an outer surface of one of the mounting flanges 106 is sealed to an inner surface of one of the film tube edges 174 to form a seal 260, and an outer surface of the other mounting flange is sealed to an inner surface of the other edge 174 of the film tube to form another seal 260. As shown in FIG. 4, the interlocking portions 104 of the reclosable fastener material are positioned outside of the envelope of the second set of heater bars 192, 194 such that the interlocking portions 104 are not heat sealed one to the other.

As mentioned, the sets of heater bars are positionally fixed in the machine direction 30. In addition, the heater bars 180, 190 are positionally fixed in the transverse or lateral direction 32 as well, such that the sets of heaters remain engaged with the opposite outer surfaces of the film edges 174 during operation (i.e., the heaters do not cycle open and closed). However, when the machine is stopped, or is not operating, the sets of heater bars 192, 194, 182, 184 are moved away from each other with the actuators 196, 198, 200, 202 in the transverse or lateral direction 32 so that the heater bars are not in contact with, and do not damage, the film tube or reclosable fastener material.

In one embodiment, the vertical seal assembly includes four heating elements 220, which are each 3 mm (0.12 inches) in diameter in one embodiment. Each heating element is mounted in a heat transfer channel, or seal bar 182, 184, 192, 194, which expands the heating surface area exposed to the film. The seal bar may be made one-piece, with a hole drilled in it for receiving the heating element, or the seal bar may be made two-piece, which are pressed together with the heating element sandwiched between the two pieces. In other embodiments, the seal bar may be made of more than two pieces. In one embodiment, the channel, or seal bar, has an outer heating surface that bears against the film with a width of about 9.5 mm (0.38 inches). In some embodiments, the width may be smaller or larger, for example 0.25 to 1.00 inches. The seal bars may be 6 to 12 inches in length, and are 10 inches in one embodiment. Each heat transfer channel, or seal bar, has ridges or flanges that slide into and mount with a corresponding interlocking portion formed in a separator bar 222, made for example of glass filled plastic, as shown in FIGS. 2 and 10. In one embodiment, the separator bar has a T-shaped slot, which rigidly mounts the heating element, and seal bar, in the transverse direction 32, while allowing the heating element and/or seal bar to expand axially in the machine or longitudinal direction 30. Other interlocking configurations for the seal bar may be envisioned, including for example various dovetail joints. The longitudinally expandable interlock between the seal bar and separator avoids warping, which may occur when attempting to rigidly mount a component that increases in size due to thermal expansion. The separator bar also insulates the heat transfer channel or seal bars, from the other components, which may reduce efficiency losses due to conduction and protect other components from high temperatures. The separator bars 222 are each coupled to a support bar 224 with a similar interlock, for example a T-slot or dove tail joint, which provides a rigid connection while avoiding thermal expansion warping. The support bars 224 in turn are coupled to the brackets 208, 210.

In other embodiments, the vertical seal(s) may be formed by pressurized hot air applied to the sides of the film tube to seal the edges of the film tube and to seal the reclosable fastener material to the film tube. In this embodiment, friction between the vertical seal assembly and the film tube would be greatly reduced or eliminated.

The connection of the support brackets 224 to the ball bearing slides 214 moveably supports the heater bars on the rails 212 supported by the frame. This allows the heater bars 182, 184, 192, 194 to be individually engaged and disengaged with the film by actuating air cylinders 196, 198, 200, 202 to move the heater bars in the transverse or lateral direction 32. In one embodiment, the first pair of actuators includes a pair of upper air cylinders 196, 198 controlling the movement of the first set of heater bars 182, 184 applying the vertical seal to the film tube, while the second pair of actuators includes a pair of lower cylinders 200, 202 controlling the movement of the second set of heater bars 192, 194 applying the seal between the film tube and the reclosable fastener material. Each cylinder has an adjustment device 230, for example a grippable nut disposed laterally outwardly, which allows an operator to adjust the engagement distance between the heaters of the first set and the heaters of the second set. For example, the operator may adjust the heater sets to create a small gap (G1 or G2) for the film or reclosable fastener material to pass through.

The first and second sets of heater bars, which are positionally fixed in the machine direction, are heated by way of the heating element 220 and transfer heat to the film tube so as to attach the reclosable fastener material to the film tube, and the edges of the film tube, while the reclosable fastener material and film tube are travelling continuously together through the vertical seal assembly.

Mounting the seal bars (heat transfer channels) in/on the high temperature plastic separator bars 222, together with the individual actuators, provides for independent positioning of all four heater bars 182, 184, 192, 194, and makes it convenient and practical to fit several heaters in a small space. Each heating element 220 is associated with its own thermocouple, such that the temperature of each heating element 220 may be independently selected and controlled for each heater bar.

One or more springs 211 (see FIGS. 1, 10A and 10B) may be disposed between the support bar 224 and brackets 208, 210. The springs may be configured as leaf springs or coil springs, for example disposed around a shaft 213 extending from the support bar. The springs 211 bias the seal bars inwardly toward each other, and allows the seal bars to automatically align to the film and reclosable fastener material, and also to move away from each other against the biasing force of the springs, for example if a film splice other disturbance passes through the vertical seal assembly.

Tear Notch Applicator

After the film tube 12, with the reclosable fastener material 40 attached thereto so as to define a composite film tube, exits the vertical seal assembly 10, the composite film tube passes a tear notch applicator 250. The tear notch applicator is optional, meaning it does not have to be deployed when manufacturing certain kinds of bags. The tear notch applicator 250 includes a knife 266 that makes a small slit 262 in the composite film tube in the longitudinal machine direction. The slits 262 is positioned between the reclosable fastener material seal 260 and the edge seal 172. The knife 266 is mounted on a slide assembly 268 that moves in the transverse lateral direction 32. The tear notch applicator 250 is positionally fixed in the machine direction, meaning the tear notch applicator is not moveable in the machine/longitudinal direction during the normal operation of the machine, but may or may not be adjusted in such a direction when the machine is not operating. A controller times the actuation of the knife 266 such that the slit 262 is made in the composite film tube at a location where the slit 262 is intersected by a knife 280 making a transverse cut to separate the bags, with a portion of the slit 262 defining a tear notch 264 at each end of the bag as shown in FIG. 21. The tear notch(s) 264 allow a consumer to more easily tear open a bag 62. It should be understood that the slitting device may include other types of cutting devices besides a knife, including without limitation air and water jets, hot wire, die, shear, ultrasonic devices, and/or combinations thereof.

The tear notch applicator includes a linear servo motor 270, which momentarily positions the knife 266 in the film path at a time coordinated with the sealing jaw motion, such that the tear notch 264 is located at the bag cutoff line. In one embodiment, the knife 266 moves in and out in about 66 milliseconds, which is the total time from when the knife starts moving toward the film until it returns to the starting position. The knife is in the film path for about 20 milliseconds in one embodiment, wherein a 0.25 inch slide is made with the film moving at 12 inches per second. Depending on the film speed and desired length of the tear notch, the knife may be in the film path for 10 to 100 milliseconds.

Below the tear notch applicator, a driven pulley system, or vertical seal pull assembly 290, pinches the film tube and reclosable fastener material, pulling the film tube and reclosable fastener material in the machine direction, e.g., downwardly in the vertical machine. The pulling action provides tension within the vertical seal assembly 10, which helps the reclosable fastener material attach consistently to the film tube. Without tension, the reclosable fastener material, or film edges, may drag against the vertical seal bars or guide blade, causing the film or reclosable fastener material to bunch up and perhaps require a machine reset.

Sealing Jaw Assembly:

Downstream of the vertical seal pull assembly, the attached reclosable fastener material and film tube travel together as a composite film tube. The composite film tube travels through a sealing jaw assembly between a pair of sealing jaws, which match speed with the composite film tube traveling downstream in the machine direction, clamp the composite film tube to form a transverse seal across the composite film tube as the sealing jaws travel with the composite film tube, cut the film tube and reclosable fastener material at a specified repeat location, open and release the composite film tube, and return in the upstream direction for the next cycle.

Referring to FIGS. 6, 7, 19 and 20, one embodiment of a sealing jaw assembly 16 is shown. In this embodiment, which is for a "continuous" motion machine, the assembly 16 includes a drive system having a pair of rails 18 that carry a pair of jaws 20, which are moveably supported on the rails with guides 44. The jaws 20 are moved together and apart on the rails by a pair of arms 22, 24, which are driven in turn by a pivot lever 26. A servo motor 33 rotates the pivot lever 26 in opposite first and second rotational directions so as to move the jaws 20 toward and away from each other as the jaws are supported by the rails. The rails 18 and jaws 20 are carried by, and move vertically with, a carriage assembly 28 in the longitudinal machine direction 30. The carriage is mounted on a pair of linear guides, shown as air cylinders 38 in this embodiment, which slide along a guide rod 43. A central column, or linear actuator 39, includes a servo belt drive, configured with a servo motor 34 and belt with air assist. The linear actuator 39 moves the carriage assembly 28 up and down in the longitudinal machine direction 30 on the air cylinders 38. The carriage is secured to a plate 41 on the linear actuator and to the sides 43 of the air cylinders. The air cylinders 38 provide a damping system for the carriage system of air pressure, while also providing an upward thrust force (e.g., about 200 lbf), or support system, to counteract the dead weight of the jaw assembly. The air pressure is automatically controlled by a regulator so that the peak servo motor torque is minimized. As such, the carriage assembly 28 can move with the air cylinders at high speeds and accelerations with reduced wear and tear on the system. In addition, the jaws 20 can be moved toward and away from each other in a lateral direction 32 independently of the vertical movement of the carriage assembly 28 by actuation of the motor 33 that is coupled to the pivot lever. The movement of the carriage assembly and the actuation of the jaws are programmable, and can be configured or operated by a controller, such as a computer or PLC, having a user interface. In one embodiment, the system is controlled by Rockwell Automation's ControlLogix, with a touchscreen human-machine interface.

The jaws 20 are configured with a sealing device and a film separation device. The sealing device is mounted to one of the jaws between upper and lower grippers. The sealing device, in one embodiment, has a length equal to or greater than the width of the composite film tube 12. The sealing device may be configured as a heat seal bar, an ultrasonic sealing device or other suitable sealing device. In one embodiment, the sealing device is configured as an insert, which is secured to the carriage with a quick-release mechanism, including for example and without limitation removable pins. The film separation device is mounted to at least one of the jaws between the upper and lower grippers. The film separation device, in one embodiment, has a length equal to or greater than the width of the composite film tube 12. The film separation device is configured in one embodiment as a cutting device, such as a knife, secured to one of the opposing carriages. It should be understood that the film separation device can include other types of cutting devices including without limitation air and water jets, hot wire, die, shear, ultrasonic devices, and/or combinations thereof, positioned between the upper and lower grippers. In one embodiment, the film separation device is secured to the jaw with a quick-release mechanism, including for example and without limitation removable pins. The film separation device is laterally moveable relative to the jaw with an actuation cylinder from a cutting position to a retracted position.

In operation, and with reference to FIGS. 6, 7, 19 and 20, the carriage assembly 28 is moved in the vertical (or longitudinal) direction 30 at the same speed and velocity as the composite film tube 12. The jaws 20 are closed by moving the pivot lever 26, which drives the jaws together, with the upper and lower grippers gripping the film tube 12. The sealing devices are then moved laterally toward each other to form a cross seal as the grippers are biased against the force of the springs, thereby closing and sealing the film tube 12 as the jaws move at the same velocity as the film tube. In this way, the sealing device is moved laterally relative to the grippers.

In one embodiment, the jaws 20 have top and bottom sealing surfaces, with a film separation device, configured as a knife in one embodiment, located between the top and bottom surfaces. The film separation device fires through the film after the seal is made. The grippers may maintain a grip on the film as the film separation device is actuated in one embodiment. In an alternative embodiment, the jaws 20 may open a slight distance, for example about 10-15 mm, and move at a different velocity relative to the film tube 12 until the film separation device is aligned with the seal and the sealing device is moved out of alignment with the seal, whereinafter the the jaws 20 are then closed again. With the upper and lower grippers again gripping the film tube 12, the film separation device is actuated, for example by moving the cutting device laterally to thereby cut the film tube across the seal. Alternatively, the jaws can be closed with an extended knife so as to make the cut while moving with the film, preferably proximate the longitudinal centerline of the seal.

The film tube is filled with product 14 after a first lower seal is made and before a next upper seal is formed as shown in FIG. 20. After the film tube is filled, the next upper seal is formed to thereby form a bag of product, and the cut is made across the seal to separate the filled bag from the film tube above. The cut simultaneously forms a pair of notches 264 from the slit 262. In this way, the filled bag is sealed at the top and bottom 64, 66 thereof all of the way to the edges thereof, which edges are formed by the cut sequence. The sequence of the seal formation, carriage shift and cut may be accomplished in several alternative ways.

Figure 22:
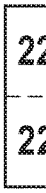
FIG. 22 is an electrical schematic of the control system for the reclosable fastener material.
Figure 22A:
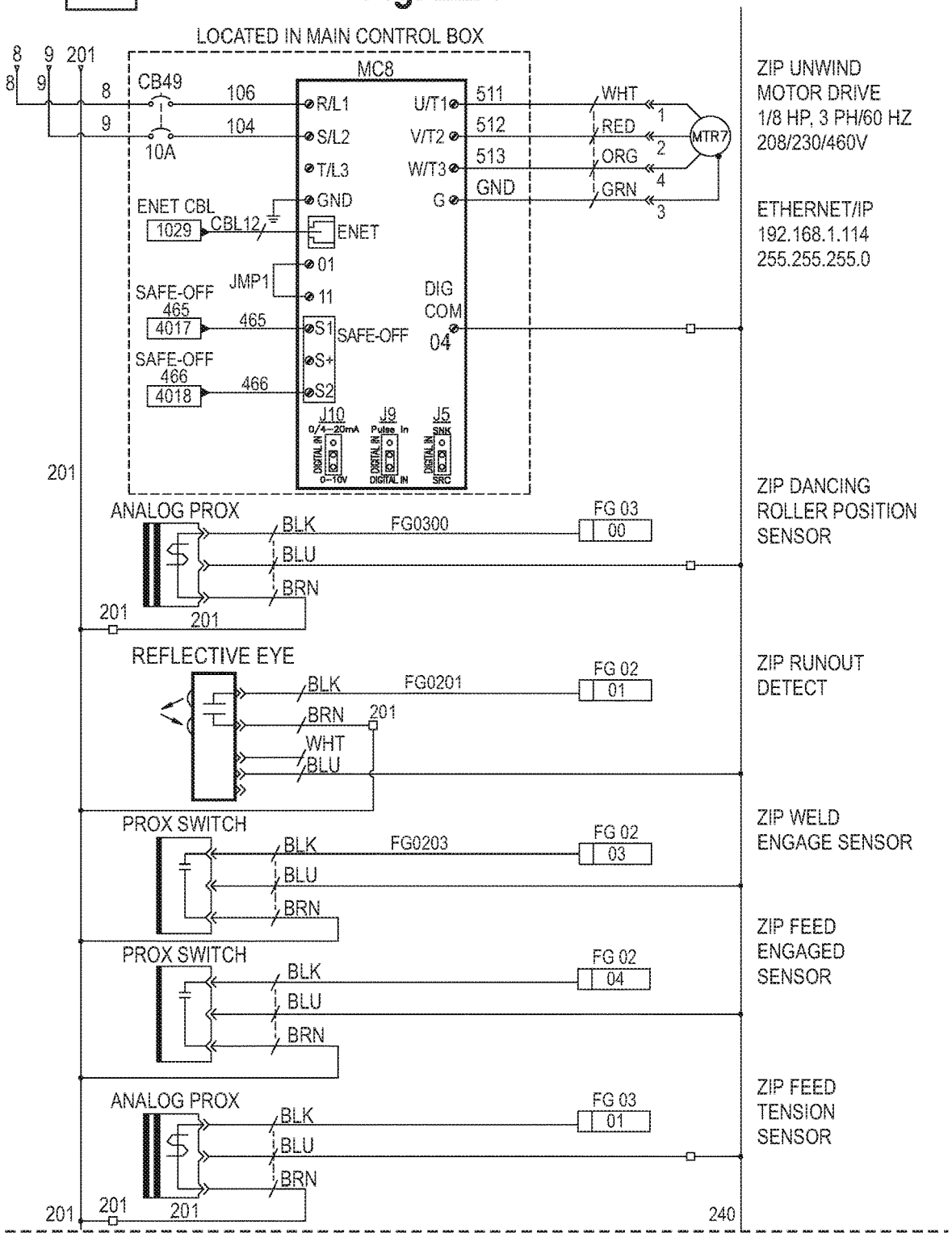
Figure 22B:
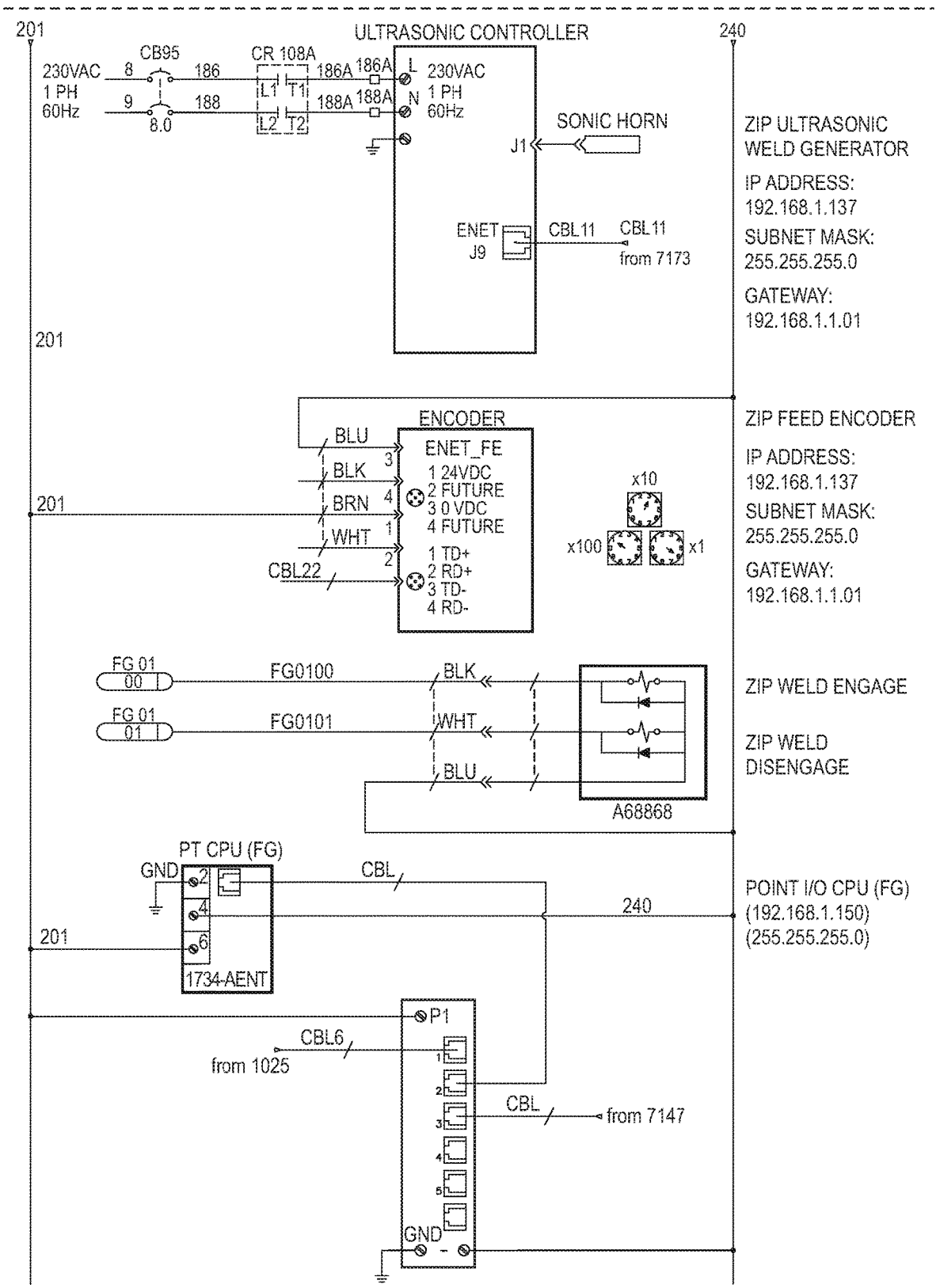
Figures 23, 23A:
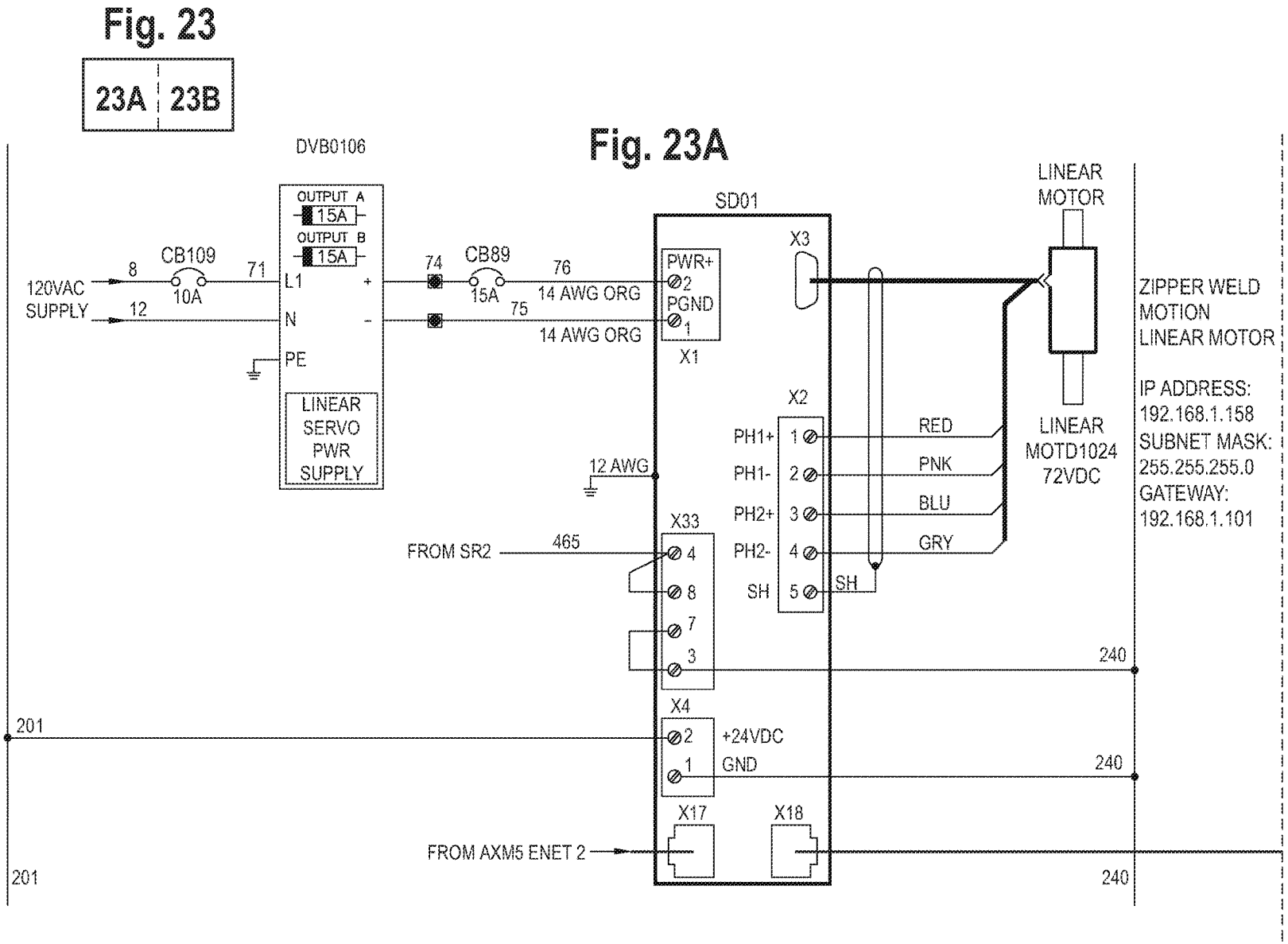
FIG. 23 is an electrical schematic of the control system for the flattening device and tear notch applicator.
Figure 23B:
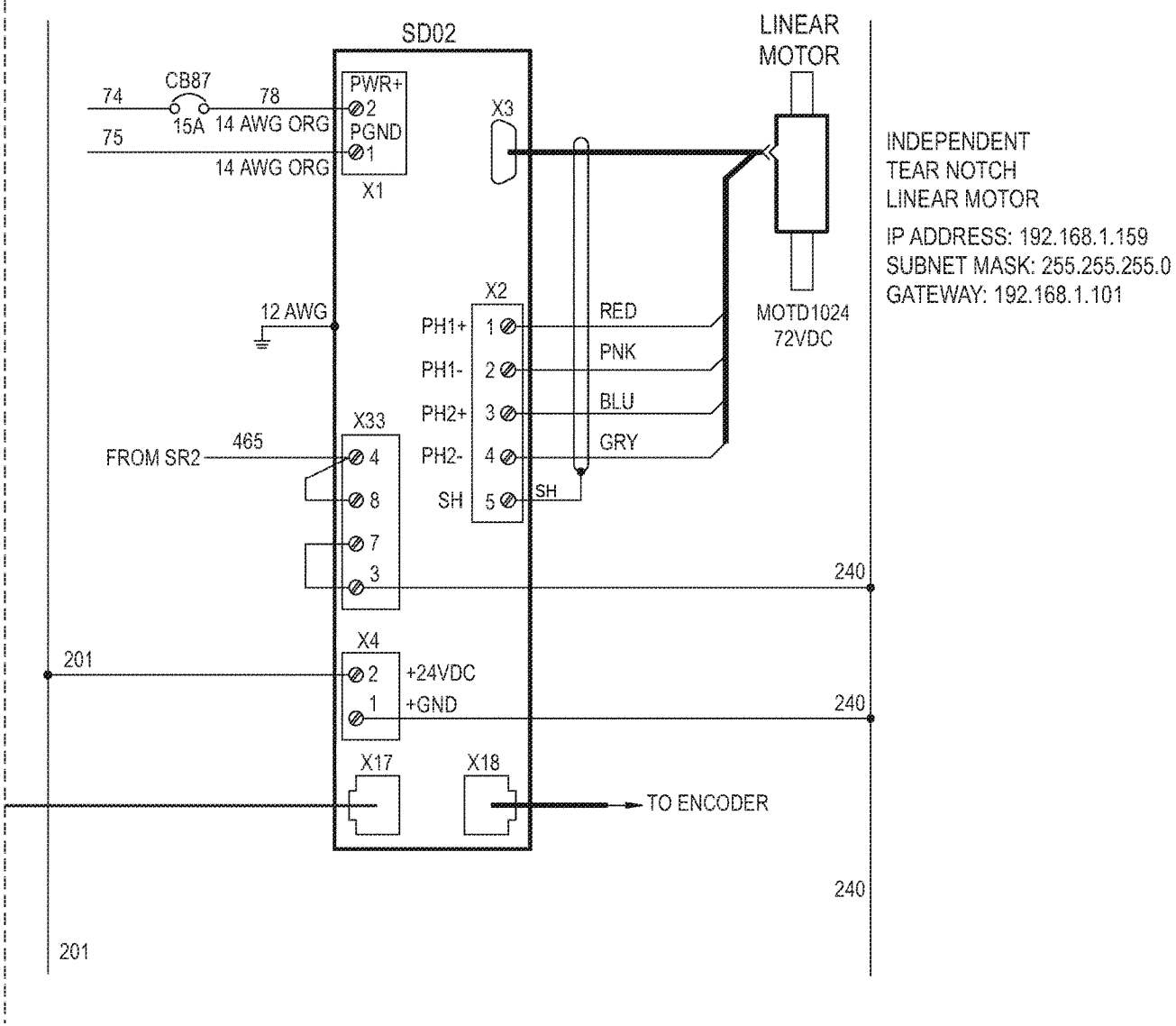
Figure 24:
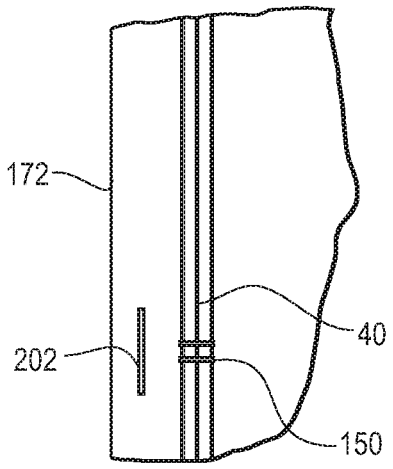
FIG. 24 is a partial front view of the composite film tube with slit applied thereto by a tear notch applicator.
Figure 25:
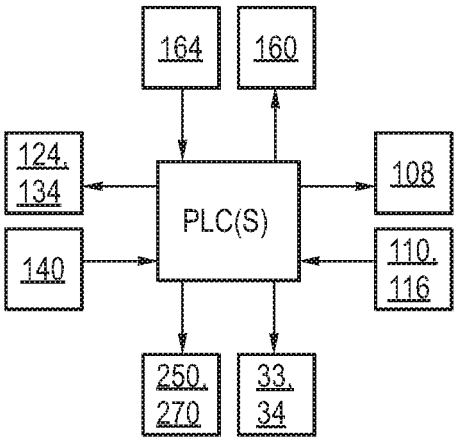
FIG. 25 is a schematic drawing of a portion of the control system.

For the entire system to operate in a continuous manner, the servo motion, including the reclosable fastener feed VFD unwind system, the flattening device, the reclosable fastener feed device, the tear notch applicator, and the sealing jaw position, are coordinated by one or more PLC (programmable logic controller) as shown for example in FIGS. 22, 23 and 25. The PLC(s) coordinate the timing of the flattening device, the tear notch applicator and the sealing jaws such that the bag transverse cutoff, the tear notch, and the reclosable fastener material weld, or flattened portion, are all aligned in the same location. When a bag with a different repeat length is desired, the PLC(s) recalculate(s) the timing of the different operations that is required achieve this colocation.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A form, fill and seal machine for making a reclosable package with a reclosable fastener comprising:

a reclosable fastener handling assembly comprising:

a flattening device reciprocally and longitudinally moveable in a machine direction, wherein the flattening device is configured to move with a reclosable fastener material and successively flatten the reclosable fastener material at spaced apart locations;

a reclosable fastener feed device configured to move the reclosable fastener material in the machine direction; and a feedback sensor configured to measure a characteristic of the reclosable fastener material upstream and/or downstream of the reclosable fastener feed device and provide an input to the reclosable fastener feed device, wherein the reclosable fastener feed device adjusts the speed of the movement of the reclosable fastener material in response to the input;

a forming tube disposed downstream of the feedback sensor, the forming tube configured to receive a film and form a film tube;

a vertical seal assembly disposed adjacent the forming tube, wherein the vertical seal assembly is positionally fixed in the machine direction, wherein the vertical seal assembly is continuously operable so as to continuously seal the film tube and reclosable fastener material; and a sealing jaw assembly disposed downstream of the vertical seal assembly, wherein the sealing jaw assembly comprises a pair of sealing jaws reciprocally moveable in a machine direction wherein the pair of sealing jaws is configured to move with the film tube and fastener material, wherein the sealing jaws are movable toward and away from each other in a transverse direction, and wherein the sealing jaws are configured to form a transverse seal on the film tube and fastener material in alignment with the spaced apart locations of flattened reclosable fastener material.

2. The form, fill and seal machine of claim 1 wherein the reclosable fastener handling assembly further comprises a rail extending in the machine direction, wherein the flattening device is reciprocally moveable on the rail.

3. The form, fill and seal machine of claim 1 wherein the reclosable fastener handling assembly further comprises an encoder positioned downstream of the flattening device, wherein the encoder is configured to monitor the speed of the reclosable fastener material and the position of the flattened reclosable fastener material and provide an input to the flattening device, wherein the speed and/or timing of the movement of the flattening device is adjusted in response to the input from the encoder.

4. The form, fill and seal machine of claim 1 wherein the reclosable fastener handling assembly further comprises a dancer assembly configured to engage the reclosable fastener material adjacent the feedback sensor, wherein the dancer assembly comprises a target portion, wherein a position of the target portion provides a tension input to the feedback sensor.

5. The form, fill and seal machine of claim 1 wherein the vertical seal assembly comprises first and second sets of heater bars, wherein the first set of heater bars are spaced and configured to seal outer edges of the film tube, and wherein the second set of heater bars are spaced and configured to seal the reclosable fastener material to the film tube.

6. The form, fill and seal machine of claim 5 wherein the first set of heater bars are moveable toward and away from each other in a transverse direction, and wherein the second set of heater bars are moveable toward and away from each other in a transverse direction independently of the movement of the first set of heater bars.

7. The form, fill and seal machine of claim 6 wherein each of the first and second sets of heater bars are associated with a different thermocouple.

8. The form, fill and seal machine of claim 5 wherein at least one of the first or second sets of heater bars comprise springs biasing the heater bars toward each other.

9. The form, fill and seal machine of claim 5 further comprising a tear notch applicator positioned downstream of the vertical seal assembly and configured to apply a slit to the continuously moving film tube between the outer edges film seal and the reclosable fastener material seal.

10. The form, fill and seal machine of claim 1 wherein the flattening device comprises an ultrasonic welder comprising a horn and an anvil adapted to be positioned on opposite sides of the reclosable fastener material.

11. The form, fill and seal machine of claim 1 wherein the reclosable fastener feed device comprises a pair of spaced apart pinch belts.

12. The form, fill and seal machine of claim 1 wherein the reclosable fastener feed device comprises a pair of spaced apart rollers.

13. The form, fill and seal machine of claim 1 wherein the reclosable fastener feed device comprises a pair of spaced apart vacuum belts.

14. A method of forming a package with a reclosable fastener comprising:

moving a reclosable fastener material continuously in a machine direction with a feed device;

moving a flattening device with the moving reclosable fastener material in the machine direction;

flattening a portion of the reclosable fastener material with the flattening device;

measuring a characteristic of the reclosable fastener material downstream and/or upstream of the feed device with a feedback sensor and providing a sensor input;

adjusting a speed of the feed device in response to the sensor input;

moving the flattening device in a longitudinal direction opposite the direction of the moving reclosable fastener material;

forming a film tube on a forming tube downstream of the feedback sensor;

continuously sealing the film tube and reclosable fastener material with a vertical seal assembly disposed adjacent the forming tube, wherein the vertical seal assembly is positionally fixed in the machine direction;

moving a pair of sealing jaws in the machine direction downstream of the vertical seal assembly; and forming a transverse seal across the film tube and fastener material in alignment with the flattened portions of the reclosable fastener material.

15. The method of claim 14 wherein the reclosable fastener handling assembly further comprises a rail extending in the machine direction, and wherein moving a flattening device with the moving reclosable fastener material in the machine direction and moving the flattening device in the longitudinal direction opposite the direction of the moving reclosable fastener material comprises moving the flattening device along the rail.

16. The method of claim 14 further comprises monitoring the speed and position of the reclosable fastener material with an encoder and providing an encoder input to the flattening device, and adjusting the speed and/or timing of the movement of the flattening device in response to the encoder input.

17. The method of claim 14 further comprises engaging the reclosable fastener material with a dancer assembly adjacent the feedback sensor, and providing a target for the feedback sensor with the dancer assembly.

18. The method of claim 14 wherein continuously sealing the film tube and reclosable fastener material comprises sealing outer edges of the film tube with a first set of heater bars and sealing the reclosable fattener material to the film tube with a second set of heater bars.

19. The method of claim 18 further comprising moving the first set of heater bars moveable toward or away from each other in a transverse direction, and moving the second set of heater bars toward and away from each other in a transverse direction independently of the moving of the first set of heater bars.

20. The method of claim 18 further comprising independently adjusting the temperature of each of the first and second sets of heater bars.

21. The method of claim 18 further comprising intermittently applying a slit to the continuously moving film tube between the outer edges film seal and the reclosable fastener material seal downstream of continuously sealing the film tube and reclosable fastener material.

22. The method of claim 14 wherein flattening the portion of the reclosable fastener material with the flattening device comprises disposing the reclosable fastener material between an ultrasonic horn and an anvil.

23. The method of claim 14 wherein moving the reclosable fastener material continuously in the machine direction with a feed device comprises moving the reclosable fastener material with a pair of spaced apart pinch belts.

24. The method of claim 14 wherein moving the reclosable fastener material continuously in the machine direction with a feed device comprises moving the reclosable fastener material with a pair of spaced apart rollers.

25. The method of claim 14 wherein moving the reclosable fastener material continuously in the machine direction with a feed device comprises moving the reclosable fastener material with a pair of spaced apart vacuum belts.

26. The form, fill and seal machine of claim 1 wherein the reclosable fastener feed device is positioned upstream of the forming tube.

27. The method of claim 14 wherein the feed device is positioned upstream of the forming tube.

* * * * *